US011427286B2

(12) United States Patent
Stacey

(10) Patent No.: US 11,427,286 B2
(45) Date of Patent: Aug. 30, 2022

(54) HULL PENETRATION ASSEMBLY, COMPONENTS THEREOF AND METHODS RELATED THERETO

(71) Applicant: CM TECHNOLOGIES, INC., Victoria (CA)

(72) Inventor: Michael C. B. Stacey, Victoria (CA)

(73) Assignee: CM Technologies, Inc., Victoria (CA)

( * ) Notice: Subject to any disclaimer, the term of this patent is extended or adjusted under 35 U.S.C. 154(b) by 288 days.

(21) Appl. No.: 16/874,777

(22) Filed: May 15, 2020

(65) Prior Publication Data

US 2020/0361573 A1 Nov. 19, 2020

Related U.S. Application Data

(60) Provisional application No. 62/849,819, filed on May 17, 2019.

(51) Int. Cl.
*B63B 27/00* (2006.01)
*B63B 83/00* (2020.01)

(52) U.S. Cl.
CPC ..... *B63B 27/29* (2020.05); *B63B 83/00* (2020.01); *B63B 2221/08* (2013.01)

(58) Field of Classification Search
CPC ..... B63B 27/00; B63B 27/29; B63B 83/00; B63B 2221/08; B63G 8/00; B63G 8/36
USPC ..... 114/221 R, 334
See application file for complete search history.

(56) References Cited

U.S. PATENT DOCUMENTS

| | | | | |
|---|---|---|---|---|
| 4,284,110 | A | 8/1981 | Divelbiss et al. | |
| 4,922,848 | A | 5/1990 | Thiel | |
| 2008/0060172 | A1* | 3/2008 | Moss | A44C 5/20 24/373 |

FOREIGN PATENT DOCUMENTS

| | | |
|---|---|---|
| CA | 2278111 | 1/2001 |

* cited by examiner

*Primary Examiner* — Lars A Olson
(74) *Attorney, Agent, or Firm* — Nicholas Garner; Oyen Wiggs Green & Mutala LLP

(57) ABSTRACT

An improved hull penetration assembly, and various components thereof are provided. These include a hull penetration mount with braces thereon, as well as a hull penetration mount comprising a lower chamber and a removable hatch coupled thereto. These further include a kit comprising these and other improvements together with a plug insertion apparatus, an object delivery apparatus, a light delivery apparatus and a borescope apparatus.

20 Claims, 22 Drawing Sheets

FIG. 21
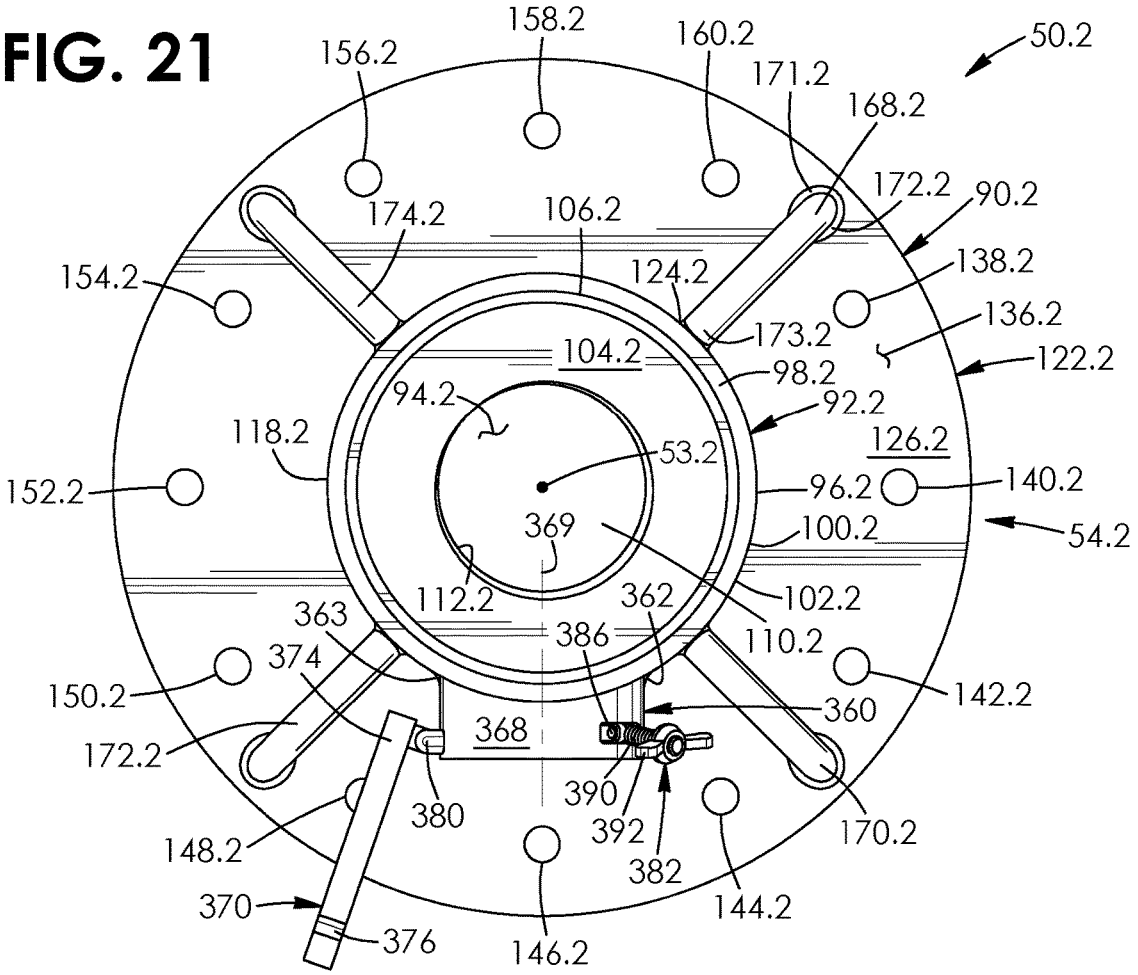
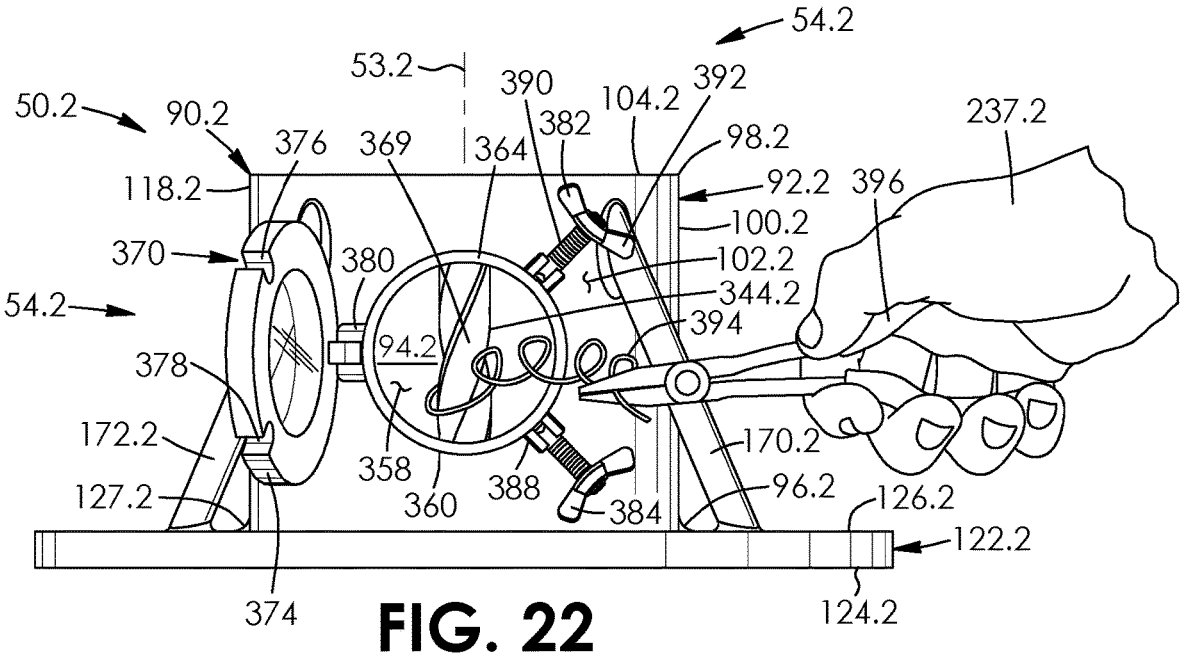
FIG. 22

FIG. 23
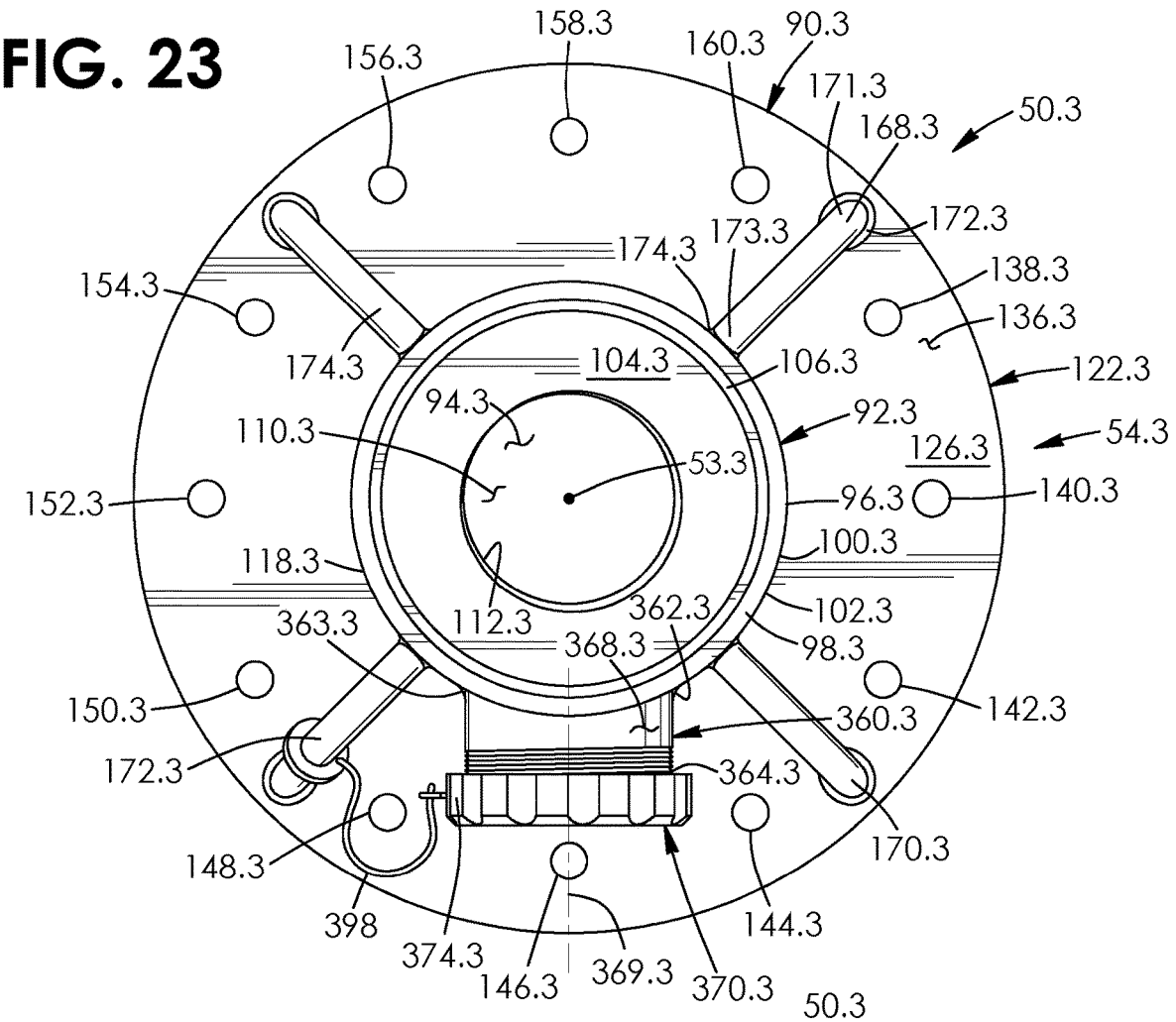
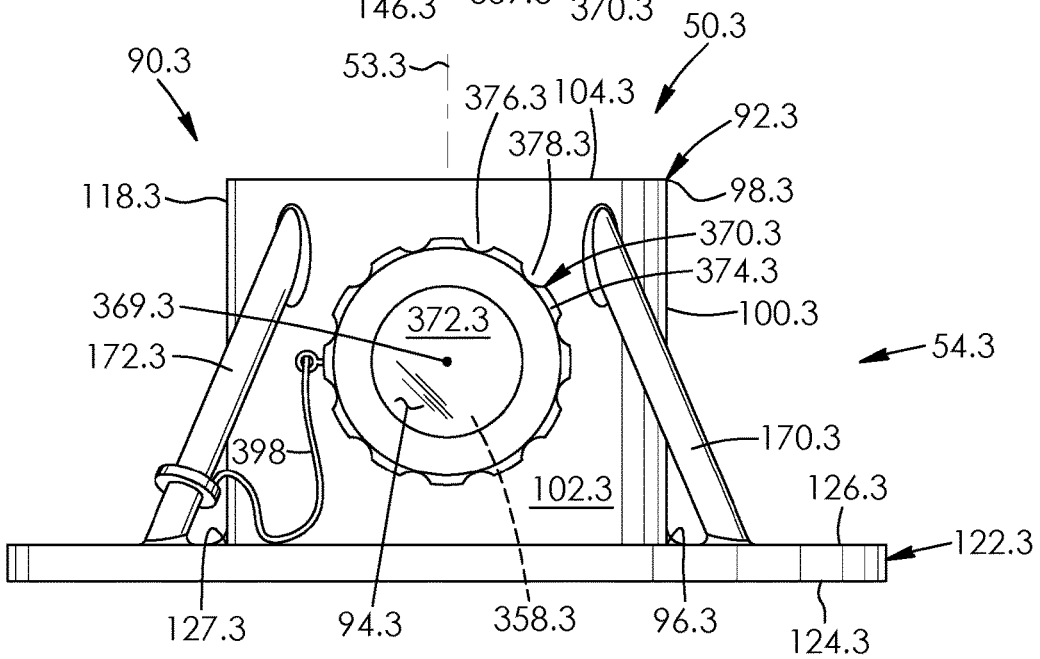
FIG. 24A

HULL PENETRATION ASSEMBLY, COMPONENTS THEREOF AND METHODS RELATED THERETO

FIELD OF THE INVENTION

The present invention relates to a hull penetration assembly. In particular, the invention relates to a hull penetration assembly, components thereof and methods related thereto.

BRIEF SUMMARY OF INVENTION

The present invention provides, and it is an object to provide, an improved hull penetration assembly, including new and improved components thereof and methods related thereto.

There is accordingly provided a hull penetration mount. The mount includes a conduit which selectively receives a drill bit and allows a controllable passage of pressurized air therethrough. The mount includes a planar base coupled to and extending radially outwards from the conduit. The mount includes a plurality of spaced-apart braces coupled to and extending between the planar base and an exterior surface of the conduit.

There is also provided a hull penetration mount according to a second aspect. The mount includes a conduit which selectively receives a drill and allows a controllable passage of pressurized air therethrough. The conduit is transparent at least in part.

There is further provided a hull penetration mount according to a third aspect. The mount includes a central conduit which selectively receives a drill and allows passage of pressurized air therethrough. The central conduit has an interior, an upper end, a lower end spaced-apart from the upper end. The central conduit has an exterior and an opening positioned between the ends thereof. The opening of the central conduit extends from the interior to the exterior of the central conduit. The mount includes a hatch extending across and sealing the opening in a closed position. The hatch is selectively removable from the opening of the central conduit. The interior of the central conduit is accessible thereby.

There is additionally provided a plug. The plug includes a deformable elongate body. The elongate body has a longitudinal axis, a first end and a second end spaced-apart from the first end thereof. The ends of the body align along the axis of the body. The body extends laterally outwards from the first end towards the second end thereof. The body has an exterior surface. The plug includes a plurality of ridges extending about the exterior surface of the body.

There is further provided a plug according to a second aspect. The plug includes a deformable elongate body. The elongate body has a longitudinal axis, a first end, and a second end spaced-apart from the first end. The ends of the body align along the axis. The body extends laterally outwards from the first end thereof towards the second end thereof. The body has an exterior surface. The plug includes indicia extending about the exterior surface of the body.

There is yet further provided a plug insertion apparatus. The plug insertion apparatus includes an elongate member having a proximal end and a distal end. The distal end of the elongate member is connectable with a plug. The elongate member has a longitudinal axis extending between the ends thereof. The plug insertion apparatus includes a planar member coupled to the proximal end of the elongate member. The planar member extends laterally outwards from the elongate member.

There is yet additionally provided a method of inserting a plug into an aperture of a hull of a vessel using a plug insertion member. The plug insertion member has an enlarged proximal end portion and a threaded distal end portion. The method includes threadably connecting the plug to the distal end portion of the plug insertion member by rotating the plug insertion member in a first rotational direction relative to the plug. The method includes inserting the plug into the aperture of the hull. The method includes applying a pounding force onto the enlarged proximal end portion of the plug insertion member to more fully insert the plug into the aperture of the hull. The method includes removing the plug insertion member from the plug by rotating the plug insertion member in a second rotational direction opposite the first rotational direction.

There is also provided an object delivery apparatus for use by a rescuer to deliver at least one object to a person trapped within an interior of a capsized vessel. The object delivery apparatus includes an elongate member having a distal end connectable with the at least one object. The elongate member extends through an aperture of a hull of the vessel such that the object is positioned within the interior of the capsized vessel. The object delivery apparatus includes a release mechanism via which the at least one object is separated from the elongate member and delivered to the person.

There is further provided a method of delivering an object to a person caught within an interior of a capsized vessel. The method includes drilling an aperture through a hull of the vessel. The method includes coupling the object to a distal end of an elongate member. The method includes inserting the elongate member through said aperture such that the object is positioned within the interior of the capsized vessel. The method includes providing a release mechanism via which the object is separated from the elongate member and delivered to the person.

There is additionally provided a borescope insertion apparatus. The borescope insertion apparatus includes a borescope. The borescope insertion apparatus includes an elongate tube within which the borescope is received. The elongate tube is transparent at least in part.

There is yet further provided a borescope insertion apparatus according to a second aspect. The borescope insertion apparatus includes a borescope. The borescope insertion apparatus includes an elongate tube within which the borescope is received. The borescope insertion apparatus includes a threaded cap through which the tube slidably and sealably extends.

The operations described above and below herein may be accomplished while inhibiting loss of air from a capsized vessel's air pocket.

BRIEF DESCRIPTION OF DRAWINGS

The invention will be more readily understood from the following description of preferred embodiments thereof given, by way of example only, with reference to the accompanying drawings, in which:

FIG. 21 is a top plan view of the hull penetration mount of FIG. 20, with the hatch thereof shown in an open position;

FIG. 22 is a front elevation view of the hull penetration mount of FIG. 21, with a drill bit of a drill bit insertion apparatus of the hull penetration assembly shown positioned within the hull penetration mount to drill an aperture through the hull of a capsized vessel, and with pliers shown extending through the open hatch and in the process of removing problematic drill bit shavings from the interior of the hull penetration mount;

FIG. 23 is a top plan view of a hull penetration mount of a hull penetration assembly according to a fourth aspect;

FIG. 24*a* is a front elevation plan view of the hull penetration mount of FIG. 23;

DESCRIPTION OF THE PREFERRED EMBODIMENTS

Figure 1:
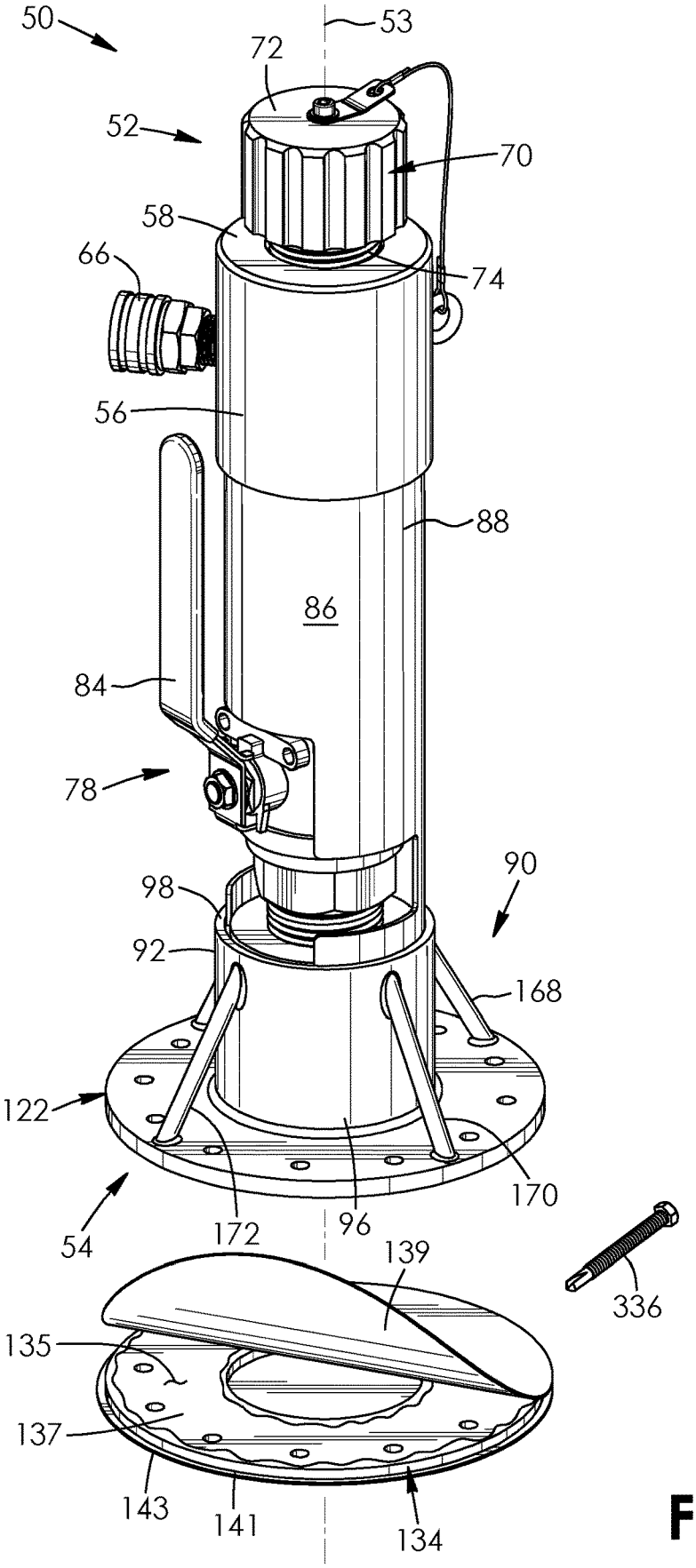
FIG. 1 is a front, top perspective view of a hull penetration assembly according to a first aspect, the assembly including a hull penetration apparatus, a plurality of fasteners and a gasket, with a plug insertion apparatus of the assembly not being shown, a drill bit insertion apparatus of the assembly not being shown, and inner and outer plugs of the assembly not being shown.

Referring to the drawings and first to FIG. 1, there is shown a hull penetration assembly 50. The assembly has a top 52, a bottom 54 spaced-apart from the top thereof, and a longitudinal axis 53 which aligns with and extends between the top and the bottom thereof.

Figure 2:
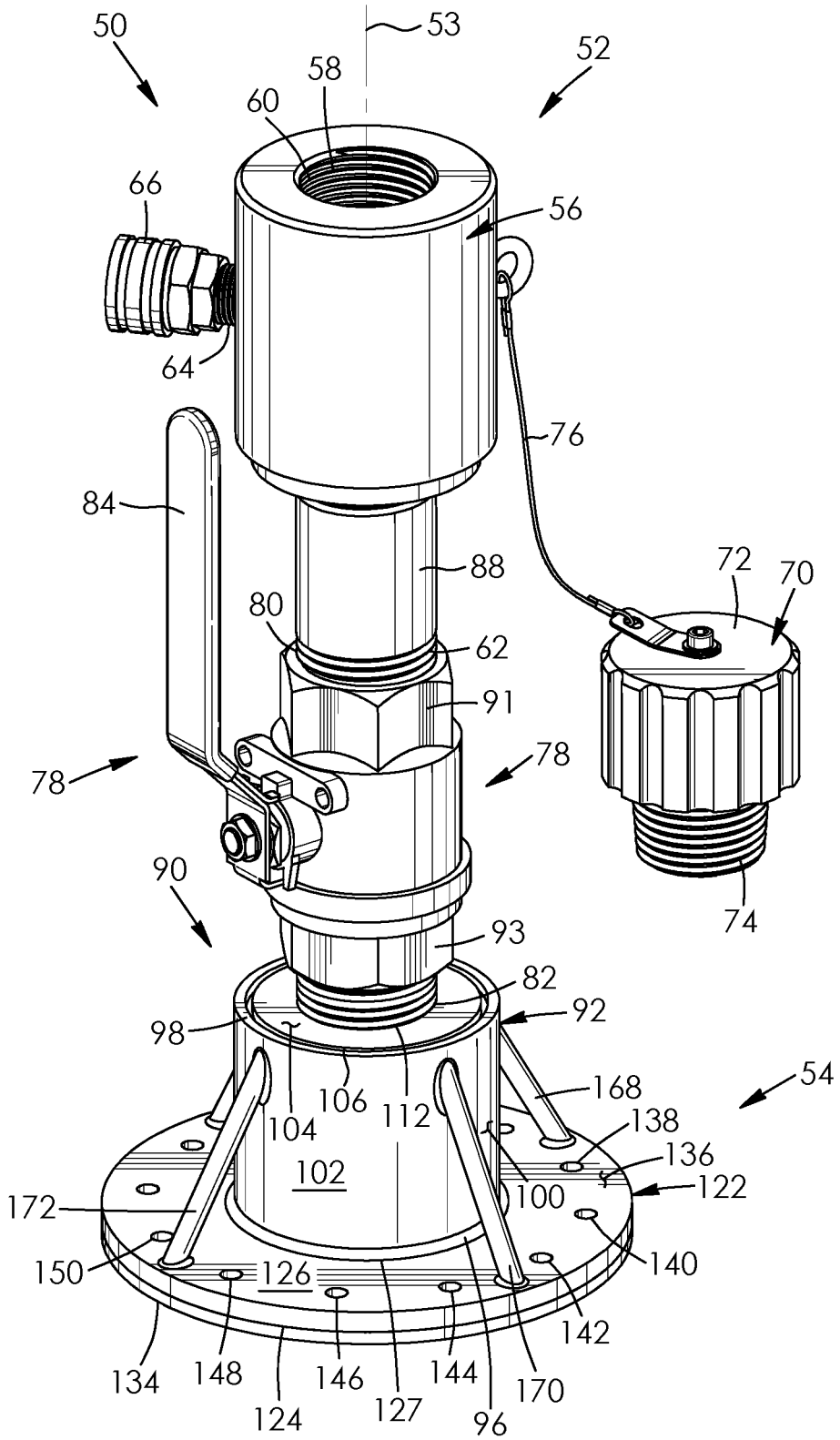
FIG. 2 is a front, top perspective view of the hull penetration apparatus of FIG. 1, with an outer cover thereof removed, the hull penetration apparatus including a hull penetration mount positioned along a lower portion thereof.
Figure 13:
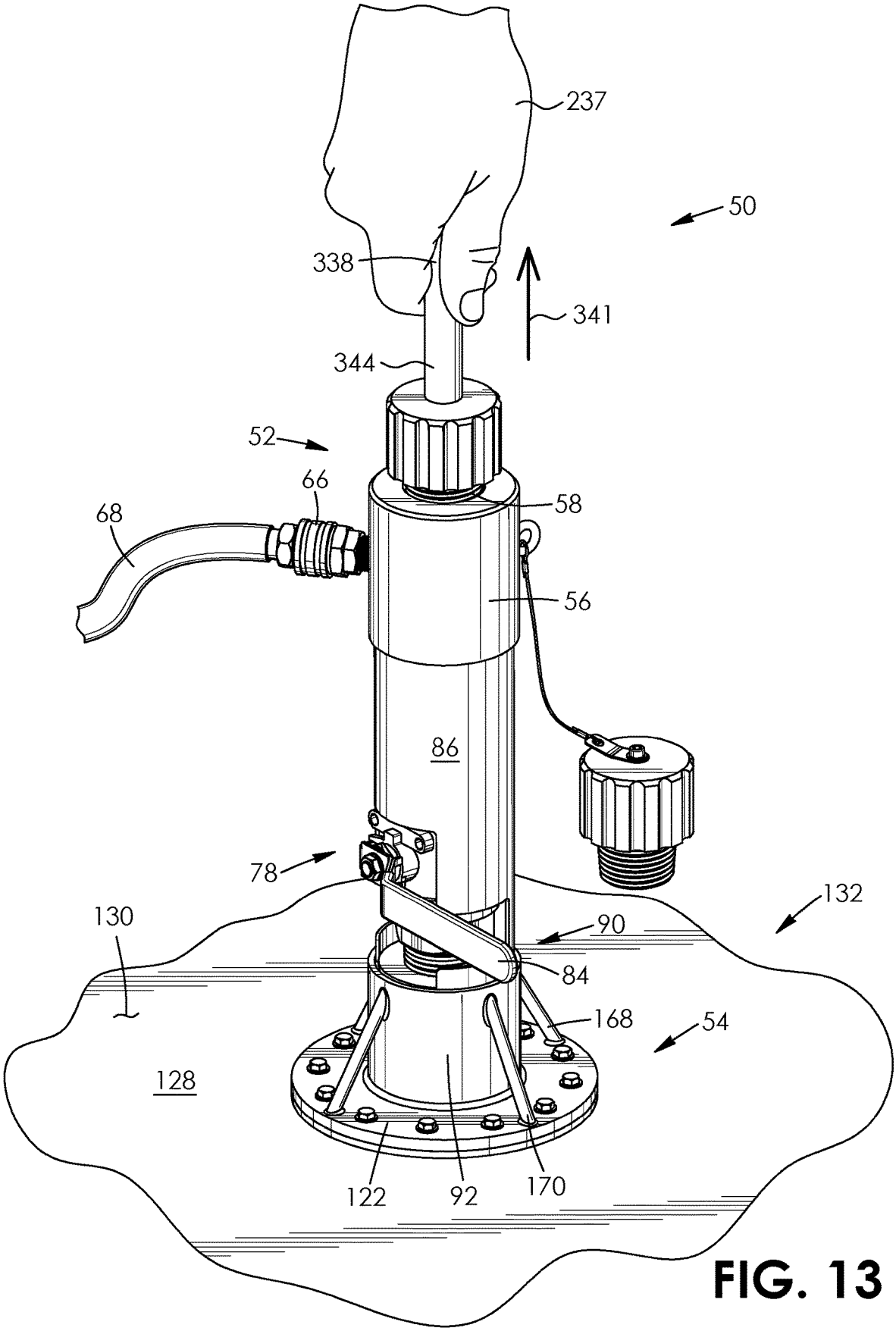
FIG. 13 is a fragmented, front, top perspective view of the drill bit insertion apparatus partially removed from the hull penetration assembly after the aperture has been drilled through the hull, with the vessel being shown in fragment.

As seen in FIG. 2, the assembly includes an upper conduit, in this example an upper chamber 56 which extends from the top 52 towards the bottom 54 of the assembly. The upper chamber is generally tubular in shape in this example. The upper chamber 56 has a bore 58 extending therethrough, with an upper, female threaded portion 60 aligned with the top 52 of the assembly. The upper chamber includes a lower, male threaded portion 62 spaced-apart from the female threaded portion thereof. The upper chamber 56 has a pressurized air port 64 in fluid communication with the bore 58 and which extends between the portions 60 and 62 thereof. The upper chamber in this example includes a quick-connect fitting 66 coupled to the port. Referring to FIG. 13, the fitting is shaped to selectively connect to an air injection hose 68 for receiving pressurized air within the upper chamber 56.

Referring back to FIG. 2, the assembly 50 includes an end cap 70. The cap has an upper gripping portion 72 and a lower male threaded portion 74. The upper gripping portion of the end cap couples to the upper chamber 56 via a tether 76 in this example. The male threaded portion 74 of the end cap 70 is shaped to threadably couple with the female threaded portion 60 of the upper chamber 56 of the assembly 50 as seen in FIG. 1. The end cap is shaped to seal the top 52 of the assembly when so coupled to the upper chamber 56.

The assembly 50 includes an air-lock mechanism, in this example a valve, in this case an air-lock ball valve 78. The valve has an upper, female threaded end 80 which threadably couples to the male threaded portion 62 of the upper chamber 56. The valve 78 has a lower, male threaded end 82 spaced-apart from the female threaded end thereof. The valve includes a handle 84. The valve 78 is open when the handle extends in parallel with the longitudinal axis 53 of the assembly 50. The handle is moveable from the open position seen in FIG. 2 to a closed position seen in FIG. 1 in which, in this example, the handle 84 extends perpendicular to the longitudinal axis of the assembly. As seen in FIG. 2, the valve 78 includes an upper gripping portion 91 and a lower gripping portion 93, each of which is hexagonal in this example in exterior shape. Ball valves, including their various parts and functionings, are known per se by those skilled in the art. Valve 78 will accordingly not be described in further detail.

As seen in FIG. 1, the assembly 50 includes a cover, in this example a tubular outer cover 86 which partially extends about the valve 78 and a lower portion 88 of the upper chamber 56 in this example.

Figure 4:
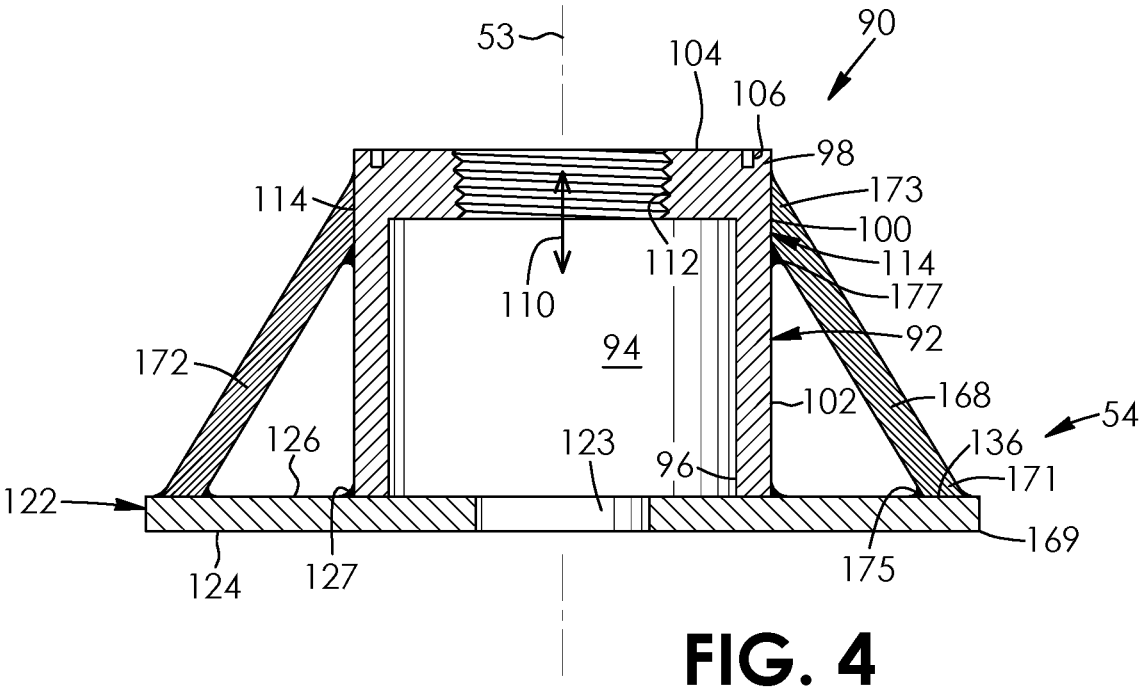
FIG. 4 is a sectional view taken along lines 4-4 of the hull penetration mount of FIG. 3.

Referring to FIG. 2, the assembly 50 includes a hull penetration mount 90. The mount includes a central or lower conduit, in this example a lower chamber 92. The lower chamber is generally a flanged tube in shape in this example. As seen in FIG. 4, the lower chamber 92 has an interior 94, a first or lower end 96 and a second or upper end 98 spaced-apart from the lower end thereof. The lower chamber has an exterior 100, and an exterior surface 102 extending between the ends thereof.

Figure 3:
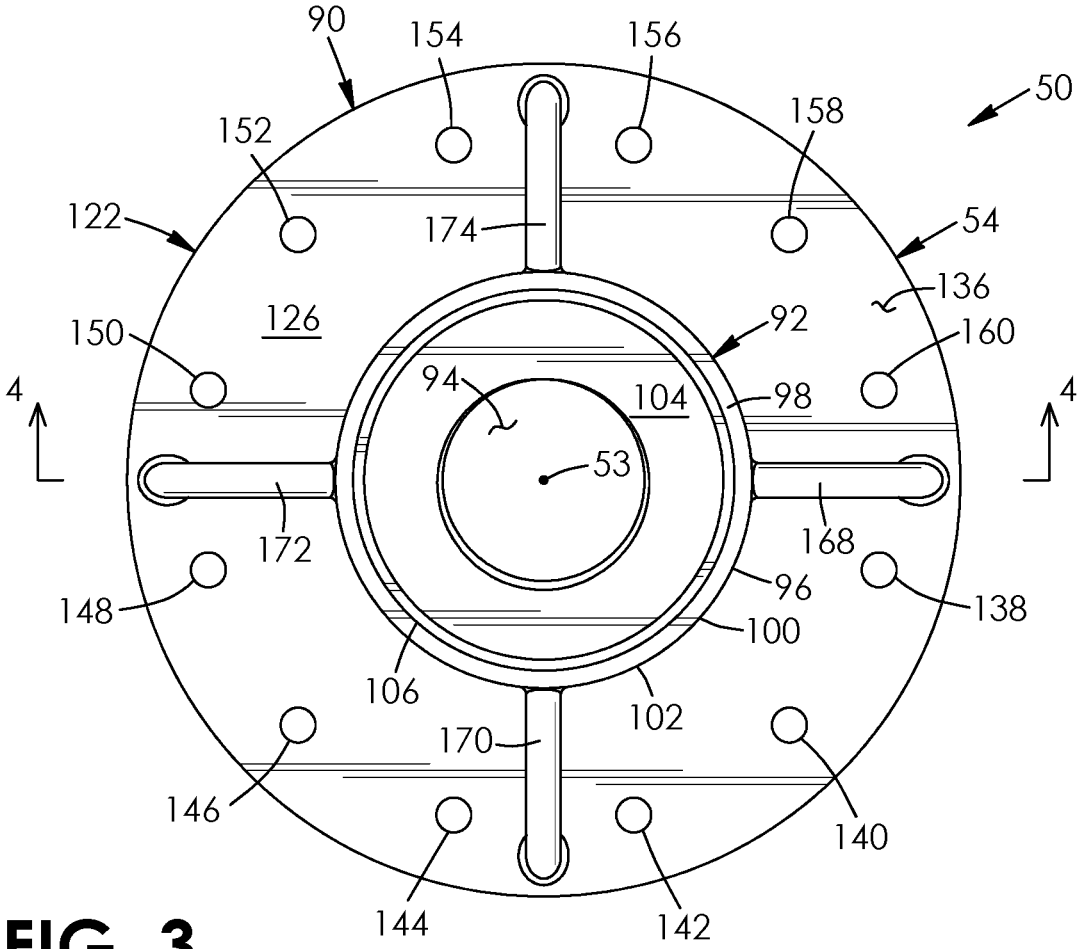
FIG. 3 is a top plan view of the hull penetration mount, with the rest of the hull penetration apparatus not being shown.

As seen in FIG. 3, the lower chamber 92 has a top 104 that is circular in this example and which extends about the longitudinal axis 53 of the assembly 50. The top of the lower chamber has an annular groove 106 shaped to receive therein bottom annular edge 108 of the outer cover 86 seen in FIG. 16. The outer cover seen in FIG. 1 is shaped to abut the top 104 of the lower chamber 92 and groove 106 seen in FIG. 4 in this example.

Still referring to FIG. 4, the lower chamber 92 extends about a passageway 110 which aligns with the longitudinal axis 53 of the assembly 50. The passageway includes the interior 94 of the lower chamber and an upper threaded bore 112 which extends through the top 104 of the lower chamber. Referring to FIG. 2, the threaded bore is shaped to receive the male threaded end 82 of valve 78, with the lower chamber 92 coupling to the valve thereby. Referring back to FIG. 4, the lower chamber 92 of the assembly 50 includes an upper portion, in this example an upper annular portion 114. The upper annular portion of the lower chamber extends about the longitudinal axis 53 of the assembly and extends from the upper end 98 towards the lower end 96 of the lower chamber.

Figure 18:
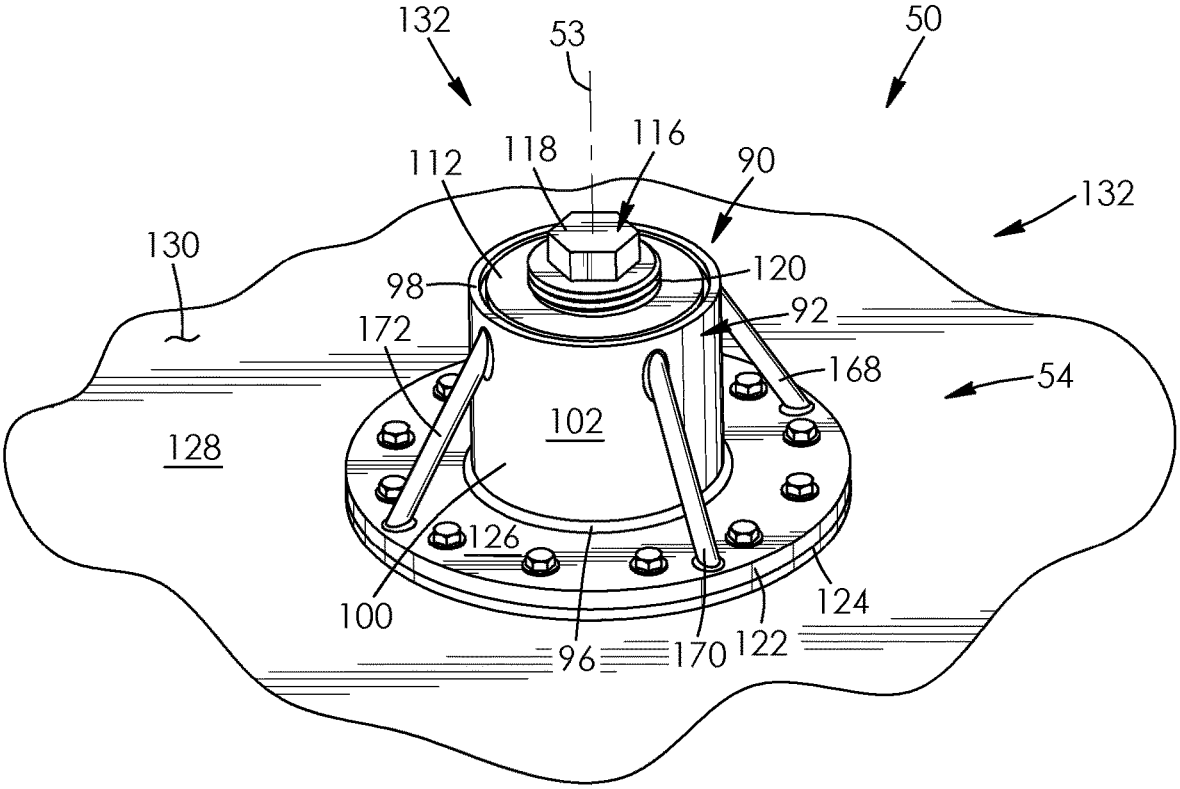
FIG. 18 is a fragmented, side, top perspective view of the hull penetration mount shown coupled to the hull of the capsized vessel, with a threaded, outer plug of the assembly shown further sealing an upper end of the hull penetration mount, with the vessel being shown in fragment.

As seen in FIG. 18, the hull penetration mount 90 may be sealed with a first or outer plug 116 that is selectively, threadably connectable to the lower chamber 92 via a bore 112 located adjacent upper end 98 of the lower chamber. The outer plug is made in this example of metal, in this case stainless steel; however this is not strictly required and the outer plug may be made of other materials in other examples. The outer plug 116 has a grippable portion 118 and a threaded portion 120 coupled to the grippable portion. Outer plug 116 may be referred to as a hull penetration mount plug.

As seen in FIG. 2, the hull penetration mount includes a planar base, in this example base plate 122. The base plate is circular in top and bottom plan view in this example. The base plate 122 has a first planar or lower surface 124, seen in FIG. 4, and a second planar or upper surface 126 best seen in FIG. 3. Each of the surfaces of the base plate 122 is circular in this example. As seen in FIG. 2, the upper surface 126 of the base plate is coupled to the lower end 96 of the lower chamber 92 via welding 127 in this example. The base plate 122 aligns with and extends about the longitudinal axis 53 of the assembly. The base plate extends radially outwards from the lower chamber 92 in this example. As seen in FIG. 4, a centrally-positioned aperture 123 extends through the base plate 122, aligns with axis 53 and forms part of passageway 110.

Referring to FIG. 18, the lower surface 124 of the base plate couples to the exterior surface 128 of a hull 130 of a capsized vessel 132 via a gasket 134 and is secured by fasteners, in this example self-tapping screws 336 seen in FIG. 1. Still referring to FIG. 1, the gasket includes an upper planar surface 135 with adhesive thereon 137 which is exposed upon removing upper cover, in this example paper 139. The gasket 134 has a lower planar surface 141 with adhesive thereon and which is exposed by selecting removing bottom cover, in this example paper 143. The gasket is made of butyl rubber in this example; however this is not strictly required and other materials may be used in other examples. The hull penetration mount 90 thus couples to the exterior surface of the hull of the capsized vessel.

Referring to FIG. 3, the base plate 122 has a peripheral edge portion 136 which is annular in this example. The base plate has a plurality of circumferentially spaced-apart apertures 138, 140, 142, 144, 146, 148, 150, 152, 154, 156, 158 and 160 extending therethrough adjacent to the peripheral edge portion thereof; however, this is not strictly required and fewer or additional apertures may be provided in other embodiments, such as four to six apertures, for example.

As seen in FIGS. 2 and 3, the hull penetration mount 90 includes a plurality of spaced-apart braces, in this example in the form of elongate members, in this case bars 168, 170, 172 and 174. The bars may be referred to as deflectors. Referring to FIG. 4, each bar has a longitudinal axis 169 and is an isosceles trapezoid in shape in longitudinal cross-section in this example. The longitudinal axes of the bars intersect with the longitudinal axis 53 of the assembly 50 in this embodiment. Each bar 168 has a first or lower end 171 that couples to the peripheral edge portion 136 of the base plate 122 via welding 175 in this example. Each bar has a second or upper end 173 which couples to the exterior surface 102 of the lower chamber 92 via welding 177 in this example adjacent to the upper annular portion 114 of the lower chamber. The bars couple to and extend between the base plate 122 and lower chamber 92. The bars thus join the outer edge of the top surface of the base plate to the top of the side of the lower chamber. The bars 168, 170, 172 and 174 are equally spaced around the lower chamber in this example.

As seen in FIG. 3, the bars are positioned so as to be circumferentially spaced-apart from each other. In this example first bar 168 and third bar 172 align with each other and second bar 170 and fourth bar 174 align with each other. Each adjacent pair of bars has three apertures positioned therebetween in this example: apertures 138, 140 and 142 extend between bars 168 and 170; apertures 144, 146 and 148 extend between bars 170 and 172; apertures 150, 152 and 154 extend between bars 172 and 174; and apertures 156, 158 and 160 extend between bars 174 and 168. The bars are shaped to inhibit debris from becoming entangled with the mount, which may be especially important when only the hull penetration mount 90 remains fastened to the hull 130 as seen in FIG. 18.

Figure 5:
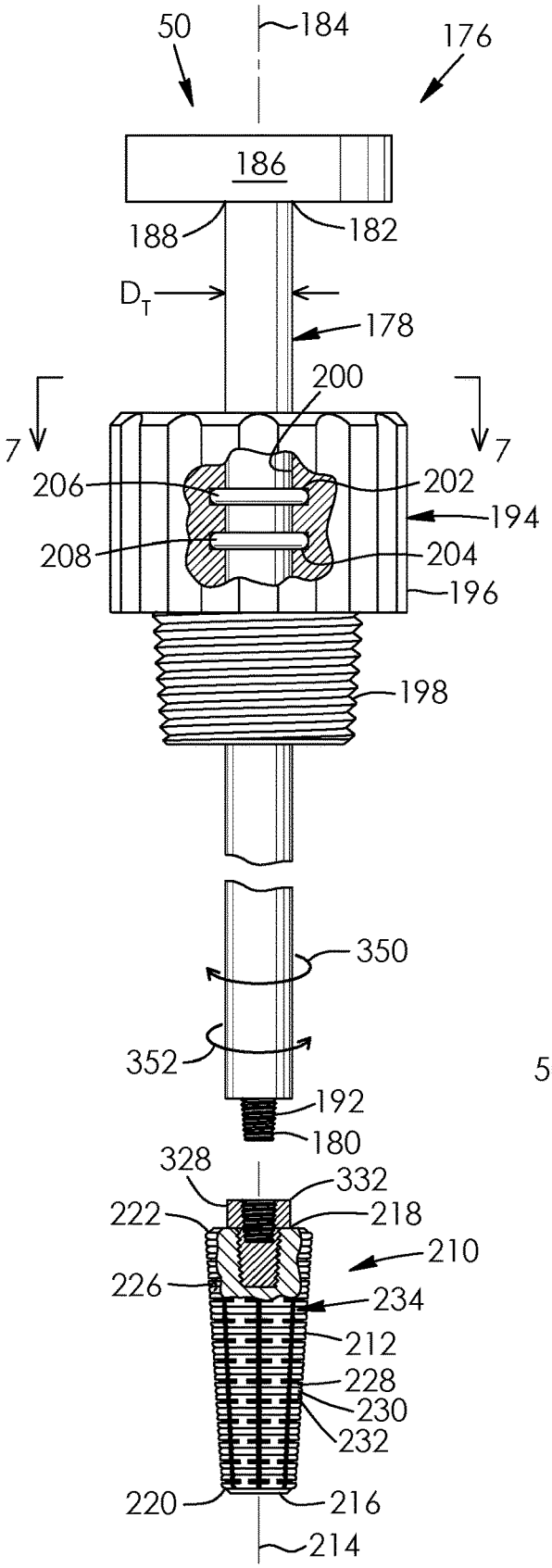
FIG. 5 is an exploded, partially sectional front elevation view of a plug insertion apparatus of the assembly of FIG. 1 together with an inner plug for selective connection thereto, the inner plug being for insertion into an aperture of a capsized vessel.
Figure 6:
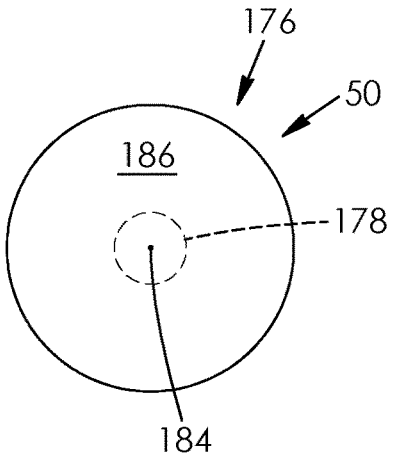
FIG. 6 is a top plan view of a flange of the plug insertion apparatus of FIG. 5.
Figure 7:
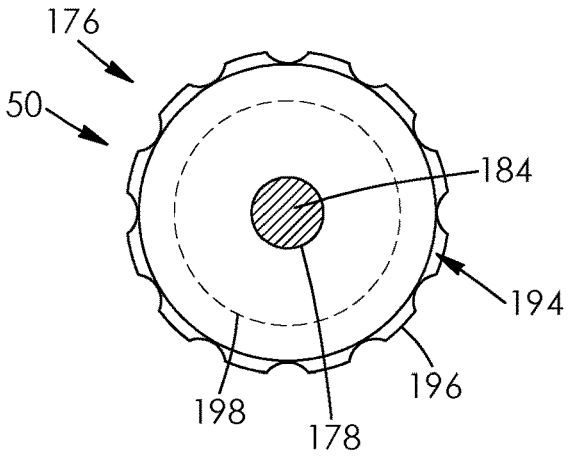
FIG. 7 is a front sectional view taken along lines 7-7 of the plug insertion apparatus of FIG. 5.
Figure 15:
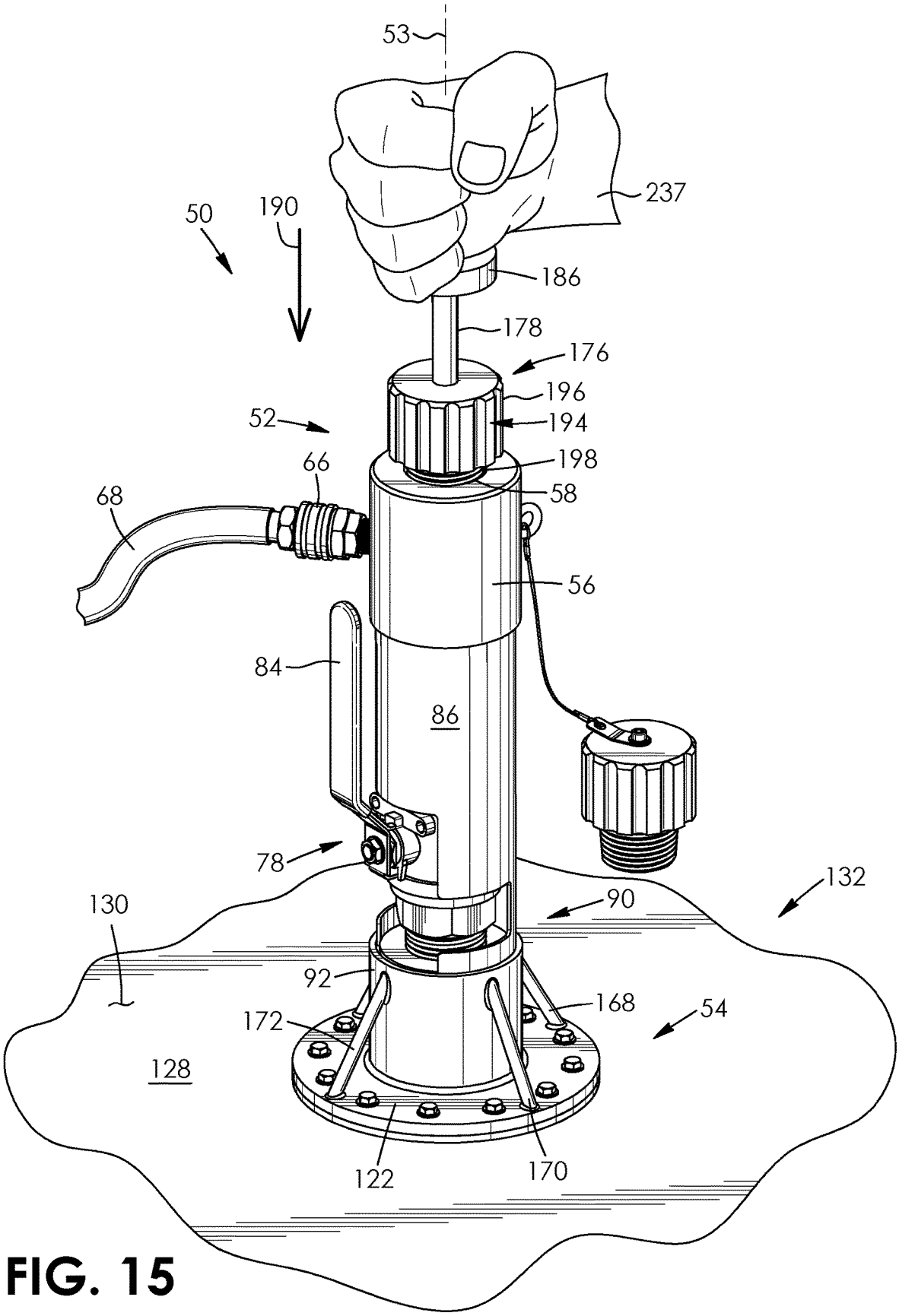
FIG. 15 is a fragmented, front, top perspective view of the hull penetration assembly of FIG. 14, with the end cap thereof being removed and with the plug insertion apparatus shown inserted into the assembly and the flange of the plug insertion apparatus of FIG. 5 shown being pounded to insert the inner plug of FIG. 5 into the aperture of the capsized vessel, with the vessel being shown in fragment.

As seen in FIG. 5, the assembly 50 includes a plug insertion apparatus 176. The plug insertion apparatus includes an elongate plug insertion member, in this example an insertion shaft 178. The shaft is made in this example of metal, in this case stainless steel; however this is not strictly required and the shaft may be made of other materials in other embodiments. The shaft 178 has a distal end 180, a proximal end 182, and a longitudinal axis 184 extending between the ends thereof. The plug insertion apparatus 176 includes a planar member, in this example a flange 186 coupled to the proximal end 182 of the shaft via welding 188 in this example. The flange extends laterally outwards from the longitudinal axis 184 of the shaft 178. The flange 186 is a cylinder in shape in this example and is shaped to receive a pounding force thereon, as seen in FIG. 15 by arrow of numeral 190. Referring back to FIG. 5, the flange may be referred to as an enlarged proximal end portion of the shaft 178. The shaft includes a threaded distal end portion 192 which extends from the distal end 180 thereof towards the proximal end 182 thereof.

The plug insertion apparatus 176 includes a cap, in this example a threaded cap 194. The cap includes a grippable portion 196 and a male threaded portion 198 coupled to the grippable portion in this example. The cap 194 has a bore 200 through which the shaft 178 extends. The cap has a pair of axially spaced-apart annular grooves 202 and 204 which are in fluid communication with and which extend radially outwards from the bore 200. The cap 194 includes a pair of sealing members, in this example O-rings 206 and 208. The shaft 178 is shaped to slidably and sealably extend through and be moveable relative to the cap 194 thereby. The threaded portion 198 of the cap is shaped to selectively threadably couple with the female threaded portion 60 of the upper chamber 56 as seen in FIG. 2. Referring back to FIG. 5, cap 194 is shaped to seal the top 52 of the assembly 50 when so coupled to the upper chamber 56, as seen in FIG. 15.

Referring back to FIG. 5, the assembly 50 includes a second or inner plug 210. The inner plug includes a deformable elongate body 212 made in this example of an elastomer, in this case thermoplastic in the form of Delrin®. However, this is not strictly required and the inner plug may be made of other materials in other examples. The body 212 has a longitudinal axis 214 which aligns and is coaxial with longitudinal axis 184 of the shaft 178 when so connected thereto. The body 212 has a first or distal end 216 and a second or proximal end 218 spaced-apart from the distal end thereof. The ends of the body align along axis 214.

Figure 8:
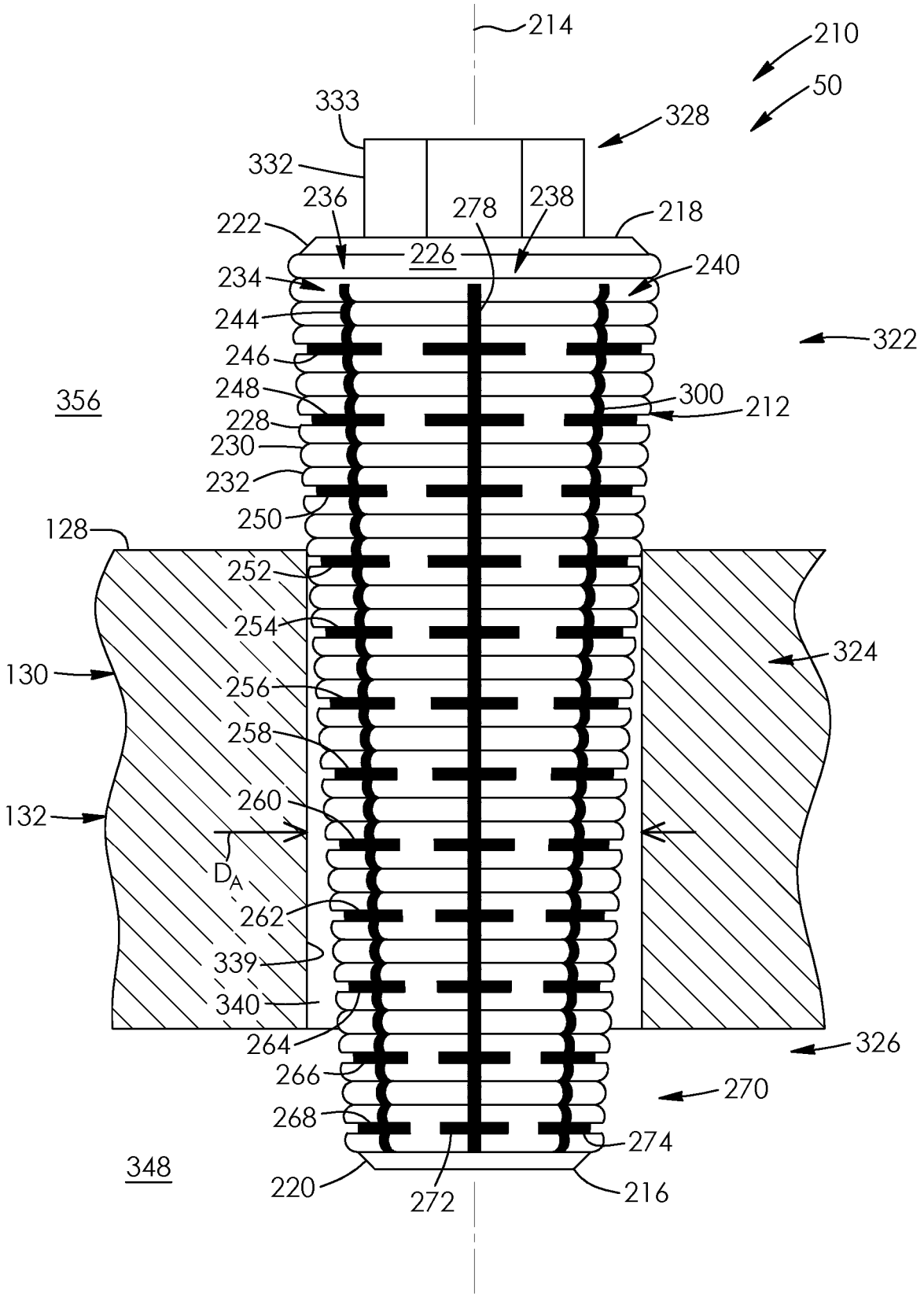
FIG. 8 is an elevation view of the inner plug of FIG. 5 shown inserted into an aperture of a hull of a capsized vessel, with the vessel being shown in fragment.
Figure 10:
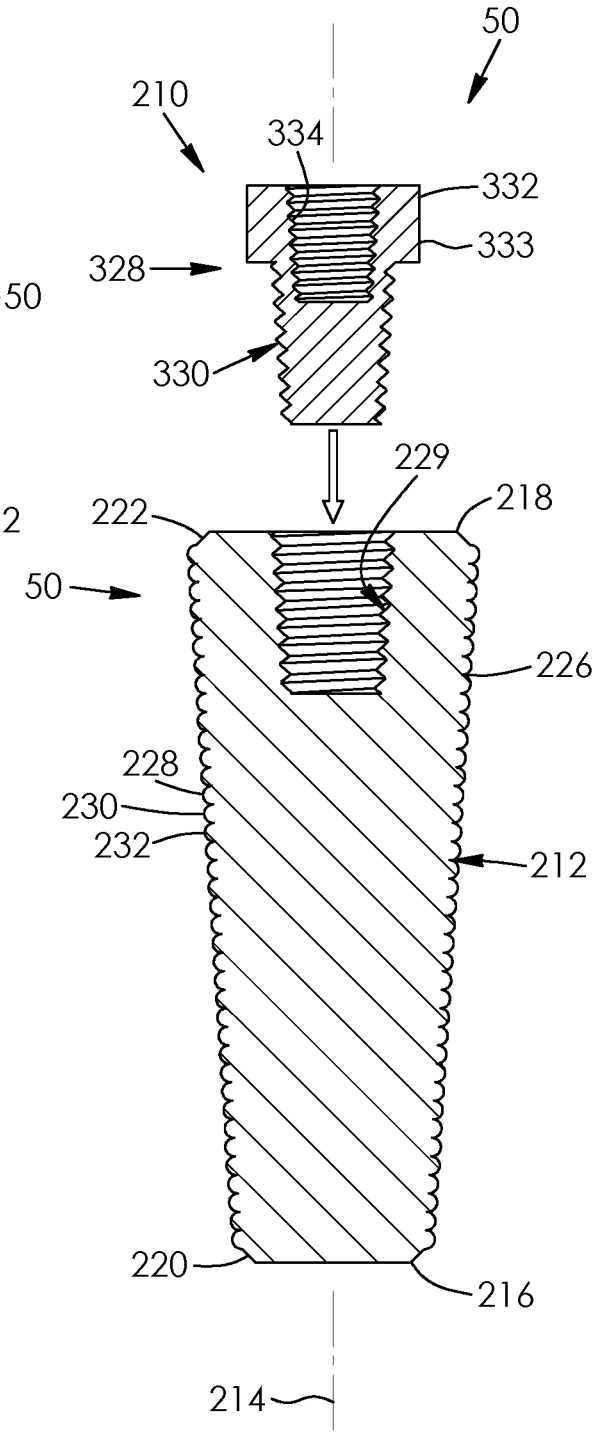
FIG. 10 is an exploded longitudinal sectional view of the inner plug of FIG. 8.

As seen in FIG. 8, the body 212 is beveled at the distal end 216 and at the proximal end 218 thereof in this example, as shown by bevelled surfaces 220 and 222. The body extends laterally and radially outwards relative to axis 214 from the distal end towards the proximal end thereof. The body 212 generally tapers from the proximal end 218 to the distal end 216 thereof. As seen in FIG. 10, the body has a threaded bore 224 extending from the proximal end towards the distal end thereof in this example. The body has an exterior surface 226 which extends from the distal end to the proximal end thereof.

The inner plug 210 includes a plurality of annular, axially spaced-apart ridges, as shown by adjacent ridges 228, 230, and 232. The ridges extend about the exterior surface of the body 212. The ridges 228, 230 and 232 are concentric and spaced-apart from each other in this example. The ridges extend along the body 212 from the distal end 216 towards the proximal end 218 of the body.

As seen in FIG. 8, the inner plug 210 includes indicia 234 extending about the exterior surface 226 of the body 212. The indicia is between the distal end 216 of the body 212 and the proximal end 218 of the body. The indicia 234 is arranged in a plurality of circumferentially spaced-apart columns 236, 238 and 240 of markings in this example comprising a plurality of axially spaced-apart and laterally-extending markings which intersect with a respective longitudinally-extending marking. This is shown by longitudinally extending marking 244 and laterally-extending markings 246, 248, 250, 252, 254, 256, 258, 260, 262, 264, 266 and 268 for column 236. Respective laterally-extending markings of columns 236, 238 and 240 align within each other in axially spaced-apart rows as seen by row 270 of laterally-extending markings 268, 272 and 274. The markings may be referred to as vertical and horizontal movement indicator lines.

Figure 9:
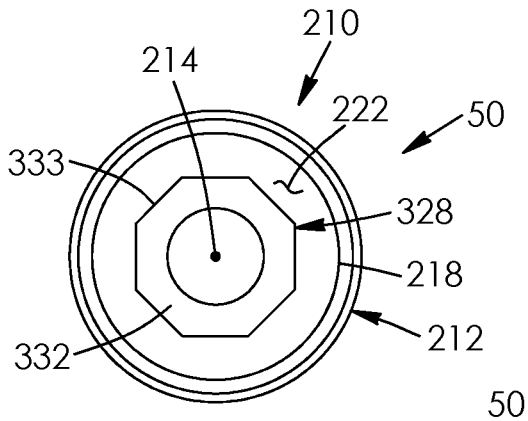
FIG. 9 is a top plan view of the inner plug of FIG. 8.

As seen in FIG. 10, the inner plug 210 includes a connector, in this example a threaded member 328 made in this example of metal, in this case stainless steel; however this is not strictly required and other materials may be used in other embodiments. The threaded member has a distal male threaded end portion 330 that is tapered and circular in lateral cross-section. The male threaded end portion threadably couples to the proximal end 218 of the body 212 via the threaded bore 224 of the body. The threaded member 328 has a proximal female threaded end portion 332 coupled to the male threaded end portion 330 thereof. The female threaded end portion has an exterior surface 333 that is hexagonal in top profile in this example as seen in FIG. 9 in this example. Referring to FIG. 10, the female threaded end portion 332 of the threaded member 328 includes a threaded bore 334 shaped to receive threaded distal end portion 192 of shaft 178 seen in FIG. 5. Inner plug 210 thus connects to the distal end 180 of the shaft. The distal end of the shaft is shaped to loosely threadably connect to the inner plug.

Figure 11:
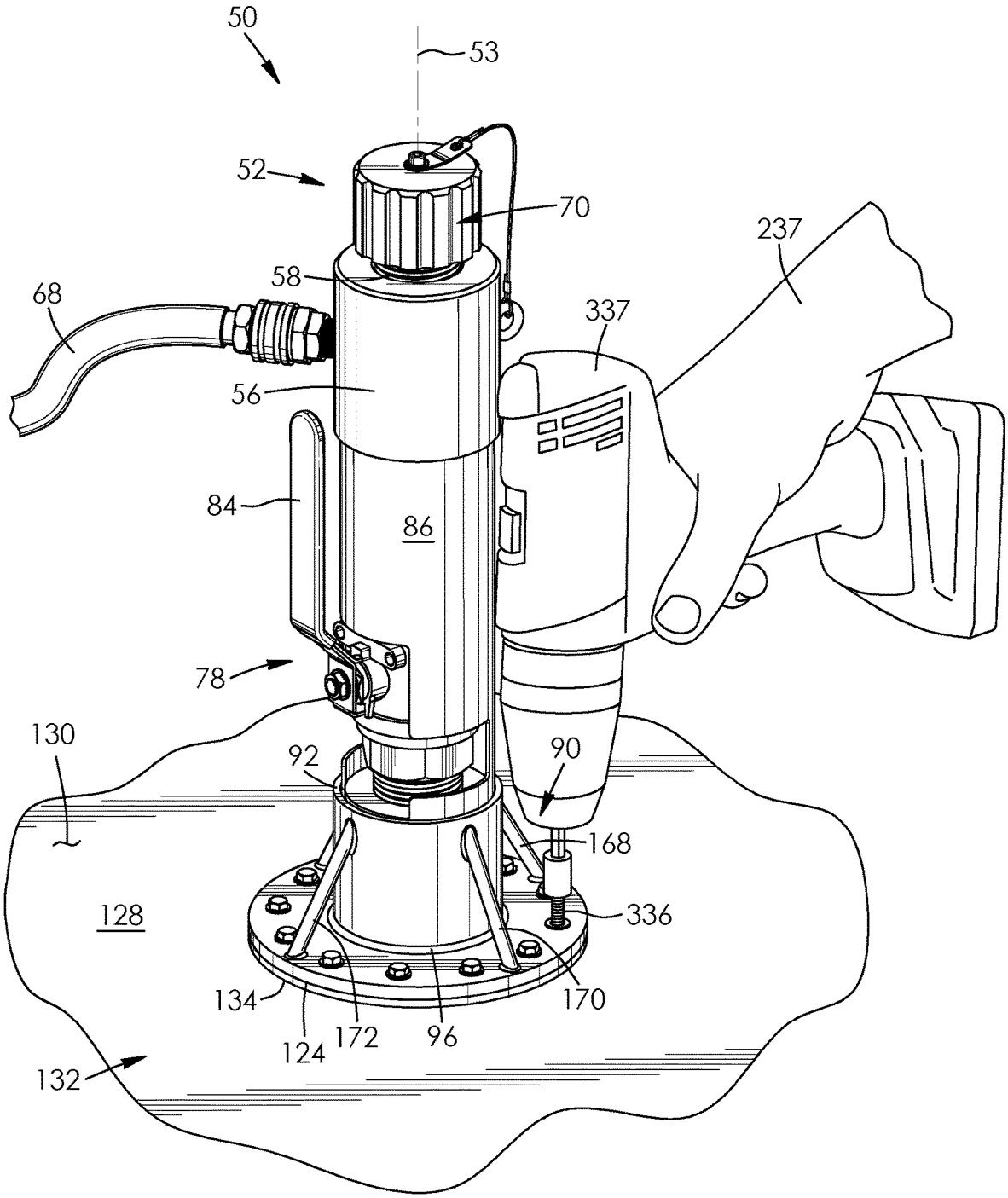
FIG. 11 is a front, top perspective view of the hull penetration assembly of FIG. 1 shown partially fastened to the hull of the capsized vessel, with the hull being shown in fragment.
Figure 17:
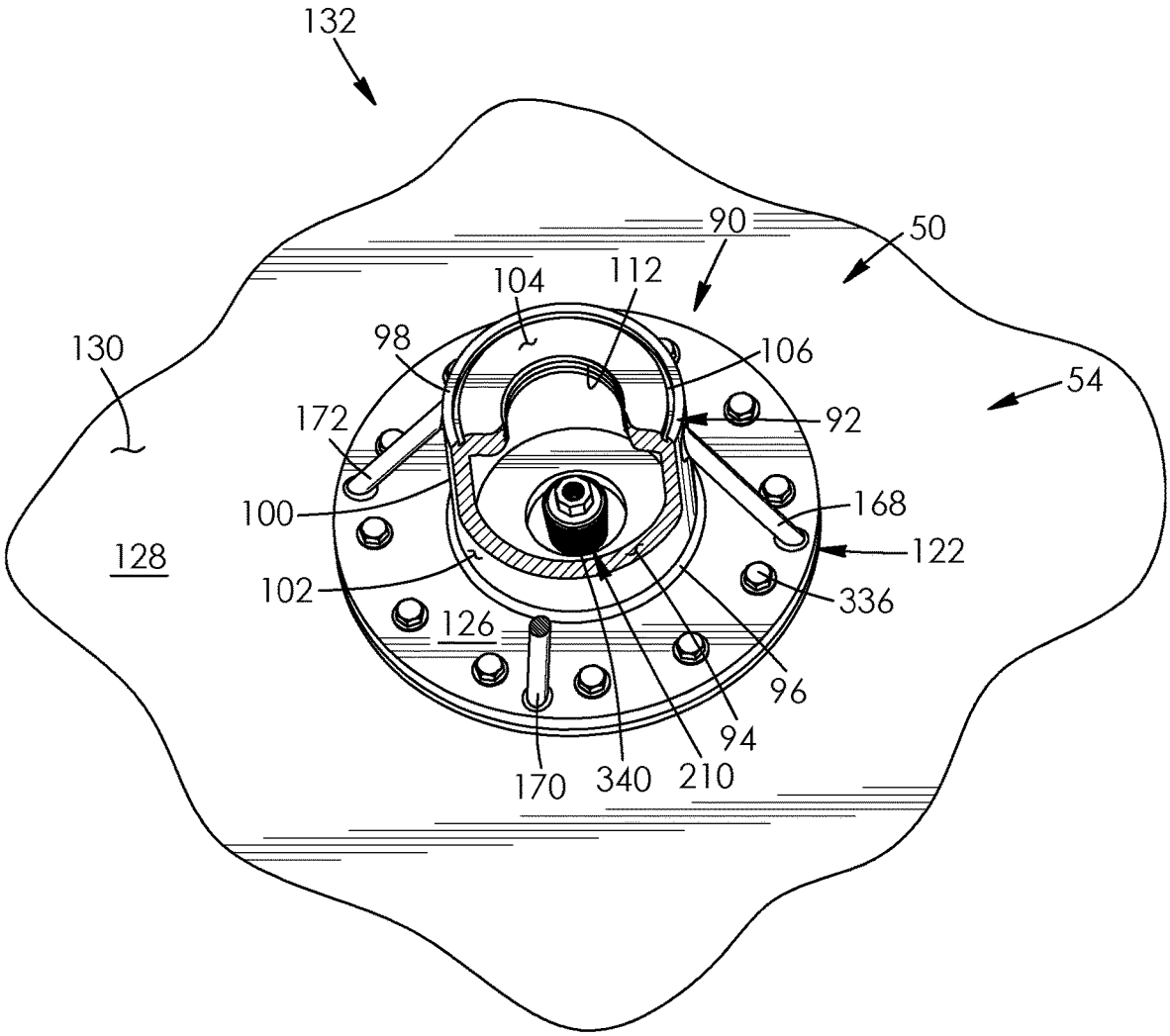
FIG. 17 is an enlarged, fragmented, top, front perspective view of the hull penetration mount of FIG. 16, with the upper chamber and ball valve of the assembly removed and with the inner plug of FIG. 5 shown inserted into the aperture of the hull of the capsized vessel.

In operation and referring to FIG. 11, the lower chamber 92 couples to the exterior surface 128 of hull 130 of capsized vessel 132 by inserting gasket 134 between the base plate 122 and the hull. The base plate is thereafter fastened to the hull via fasteners, in this example self-tapping screws 336 extending through corresponding apertures, such as aperture 138 of the base plate 122 seen in FIG. 3 and being secured in place via a power tool 337. The lower chamber 92 thus couples to the hull 130 such that the lower end 96 thereof sealably couples to the hull. The number of screws 336 seen in FIG. 17 is not strictly required; only four to six screws may be sufficient in some embodiments, and still less in other embodiments. In the disclosure as herein described, there are provided twelve apertures 138, 140, 142, 144, 146, 148, 150, 152, 154, 156, 158 and 160 seen in FIG. 3 extending through the base plate 122, with as few screws extending therethrough as is necessary. Referring to FIG. 17, the unused apertures are sealed effectively by the design of the gasket 134.

Referring to FIG. 11, end cap 70 is thereafter removed from the upper chamber 56.

Figure 12:
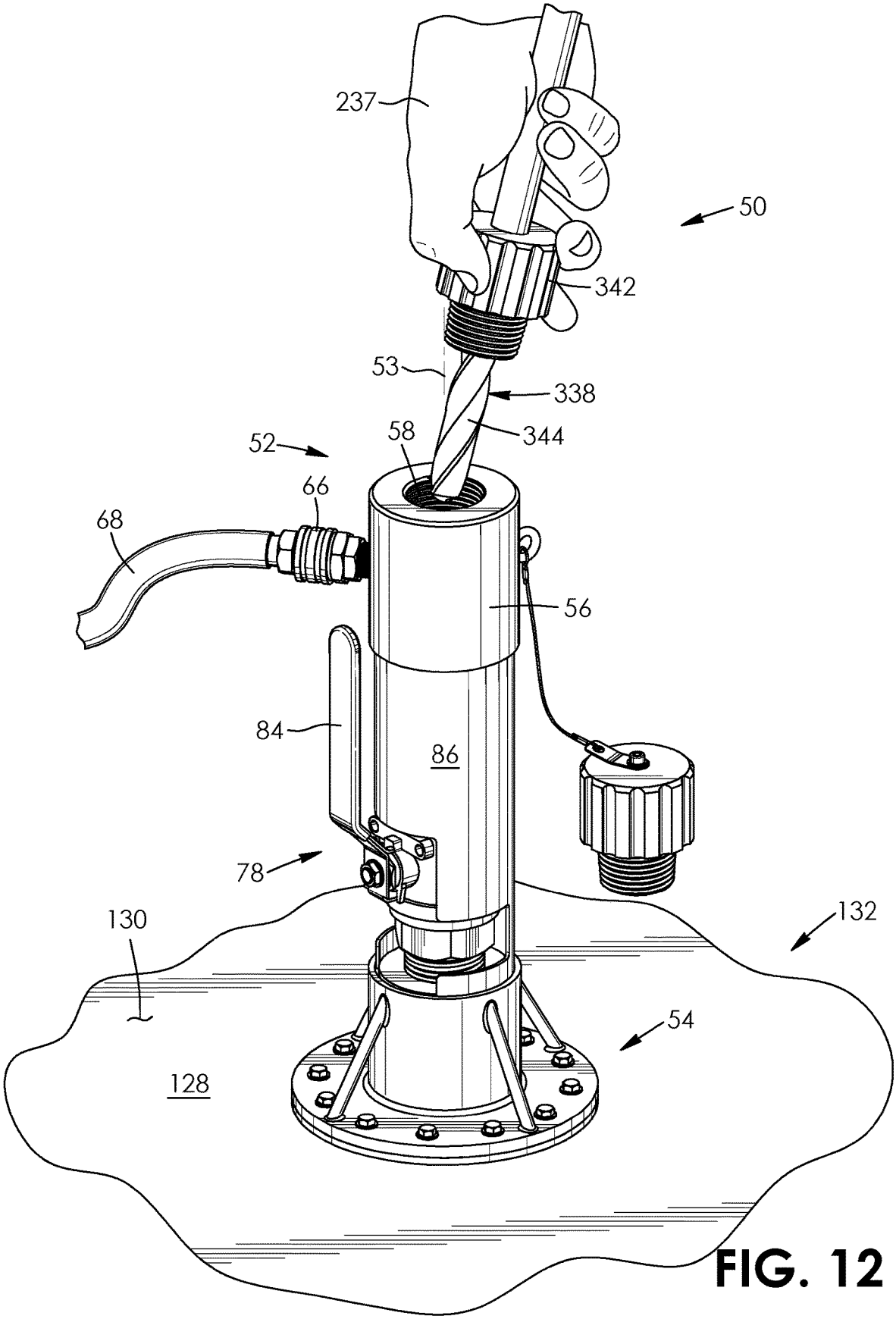
FIG. 12 is a fragmented, front, top perspective view of the hull penetration assembly of FIG. 11, with a drill bit insertion apparatus partially inserted into the assembly for drilling an aperture through the hull of the capsized vessel, and with the vessel being shown in fragment.

A drill bit insertion apparatus 338 seen in FIG. 12 is next deployed. The drill bit insertion apparatus includes a threaded cap 342 which is substantially similar to threaded cap 194 of plug insertion apparatus 176 seen in FIG. 5. Referring back to FIG. 12, threaded cap 342 is shaped to threadably couple to the top 52 of the assembly 50 and seal the interior of the assembly thereby. A drill bit 344 of the drill bit insertion apparatus 338 is shaped to slidably extend through the threaded cap 342. The drill bit is inserted into the assembly 50 for drilling an aperture 340, seen in FIG. 8, through the hull 130.

Figure 14:
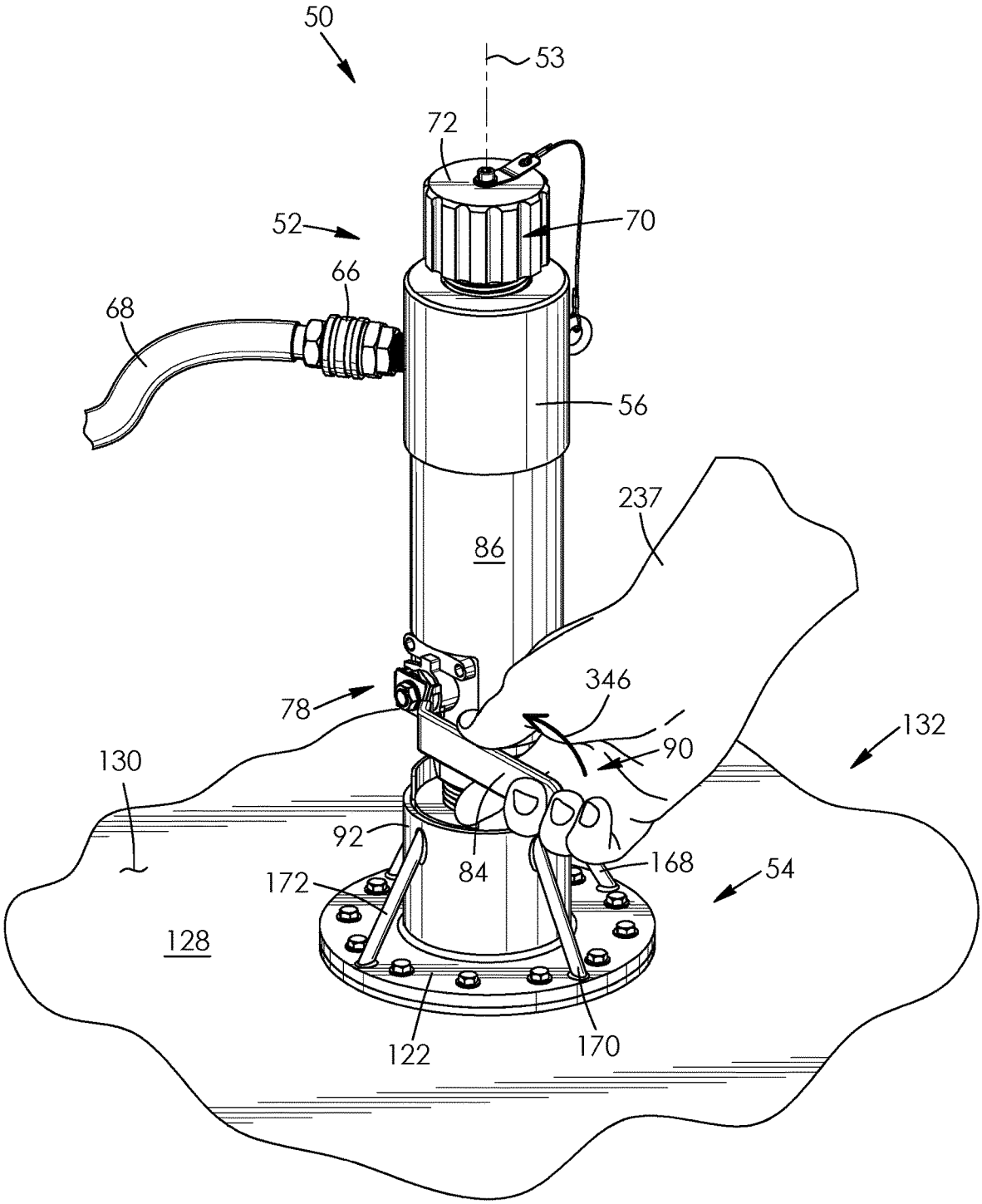
FIG. 14 is a fragmented, front, top perspective view of the hull penetration assembly with the drill bit insertion apparatus removed, an end cap re-connected thereto the hull penetration assembly to seal the hull penetration assembly, and a ball valve in the process of being opened to enable pressurized air to pass through the hull penetration assembly and into the interior of the capsized vessel, with the vessel being shown in fragment.

As seen in FIG. 13, pressurized air hose 68 couples to fitting 66. Referring to FIG. 2, the upper chamber 56 and lower chamber 92 are thus shaped to selectively receive a drill bit and pressurized air therethrough. Referring back to FIG. 13, the drill bit insertion apparatus 338 is next removed, as shown by arrow of numeral 341. As seen in FIG. 14, the end cap 70 is once more coupled to the upper chamber 56. The handle 84 of valve 78 is next moved to an open position, as shown by arrow of numeral 346, thereby enabling pressurized air to enter into the interior 348, seen in FIG. 8, of the capsized vessel 132. Additional particulars of these steps, including how the air valve performs an air lock function to inhibit escape of air from the interior of the vessel during the drilling process, are described in further detail in earlier filed Canadian Patent No. 2,278,111, the disclosure of which is hereby incorporated herein by reference.

Still referring to FIG. 8, when the interior 348 of the vessel 132 no longer needs to be accessed for inserting air therein, for example, and it is desired to plug aperture 340 in the hull 130, the handle 84 of the valve 78 is moved to a closed position seen in FIG. 14. The end cap 70 is next threadably removed from the upper chamber 56. Referring to FIG. 5, the inner plug 210 is threadably connected the distal end portion 192 of the shaft 178 by rotating the shaft in a first rotational direction 350 relative to the inner plug. As shown in FIG. 15, threaded cap 194 of the plug insertion apparatus 176 is next threadably and sealably coupled to the upper chamber 56.

As seen in FIG. 8, the inner plug 210 is inserted through the hull penetration assembly 50 and into aperture 340 of the hull 130. The body 212 of the inner plug is shaped such that the proximal end 218 thereof is larger than the aperture and the distal end 216 thereof is smaller than the aperture 340 of the hull 130. Referring to FIG. 15, applying a downward pounding force, as shown by arrow 190, onto flange 186 functions to more fully insert the inner plug 210 into the aperture of the hull. As seen in FIG. 5, the inner plug is next removed from the shaft 178 by rotating the shaft in a second rotational direction 352 opposite the first rotational direction 350. This may occur by hand-rotation of the shaft, for example.

Figure 16:
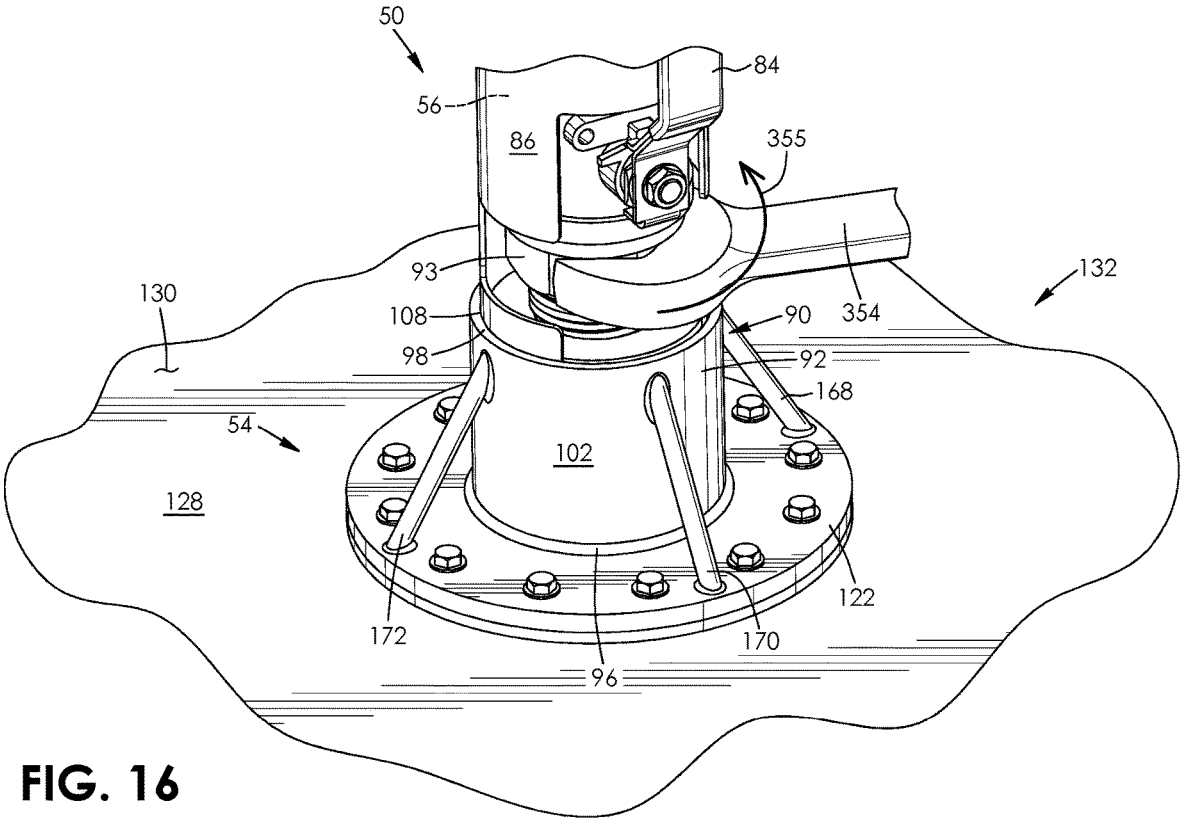
FIG. 16 is an enlarged fragmented, front, top perspective view of the hull penetration assembly of FIG. 15, after the inner plug has been inserted into the aperture of the capsized vessel, with an upper chamber of the assembly being shown in the process of being removed from the hull penetration mount, with the vessel being shown in fragment.

Referring to FIG. 16, the valve 78 and upper chamber 56 of the assembly 50 are next unthreaded and thus removed from the hull penetration mount 90. This is achieved by applying torque to grippable portion 93 of the valve using a wrench 354 in this example in the rotational direction shown by arrow of numeral 355. However, prior to removing valve 78 and upper chamber 56, the operator confirms that the inner plug 210 is securely inserted into aperture 340 seen in FIG. 17, by observation of the plug through an inspection hatch 370 seen in FIG. 20 and described further below.

The hull penetration mount 90 with the rest of the assembly 50 removed is shown in FIG. 17. Inner plug 210 is seen inserted into the aperture 340 in hull 130.

Referring to FIG. 18, outer plug 116 is next threadably coupled to upper threaded bore 112 of the lower chamber 92 and thus seals the upper end 98 of the lower chamber. The lower chamber and outer plug further enclose the aperture 340 so plugged in FIG. 17 thereby and thus further inhibit fluid communication between the interior 348 of the vessel 132, seen in FIG. 8, and the exterior 356.

Many advantages may result from the assembly 50 as herein described. For example, the bars 168, 170, 172, 174 seen in FIGS. 2 to 4 may prevent damage to the assembly by deflecting objects colliding with the assembly and hull penetration mount 90. The bars may thus function to inhibit dislodgement of the hull penetration mount from the vessel. The assembly 50 as herein described may therefore help protect the lower chamber against dislodgment by debris, logs or contact with small craft attending the capsized vessel because of the ability of the slanted bars 168, 170, 172, 174 to deflect objects that so pass over the lower chamber when only the lower chamber remains fastened to hull after "partial removal" process. The bars so shaped and sloped may also help prevent tow lines or other ship's lines from obtaining a purchase on the lower chamber and pulling it away from the hull and damaging its seal with the hull or causing capsized vessel to roll or otherwise move dangerously.

Still referring to FIGS. 2 to 4, the bars 168, 170, 172 and 174 may function to buttress the lower chamber 92 and strengthen the assembly 50 as a whole. Sizing and placement of the bars may ensure that space therebetween remains to fit a drill and nut driver assembly over screws 336 seen in FIG. 17. The bars 168, 170, 172 and 174 may further provide convenient, strong points of attachment to loose objects may be clipped or coupled thereto. This may obviate the need for dedicated eye screws attached to the lower chamber, for example.

The inner plug 210 seen in FIG. 8, with its malleability and ridged sides, may promote a friction fit with portions 339 of the hull 130 extending about aperture 340 for better sealing the aperture. The tapered malleable plug so shaped, with its sides which feature small ridges that facilitated "grip", enable the plug to be jammed into the aperture in the hull and with inadvertent removable or dislodgement thereof thereafter being inhibited. The inner plug 210 so shaped may facilitate embedding and retaining of the inner plug in the aperture 340 of the hull 130 in part because the shallow horizontal ridges, spaced closely together horizontally, function to grip portions 339 of the hull 130 facing the aperture 340 and enable a strong friction fit. The body 212 of the inner plug 210 in this example is two inches long, 0.700 inches in diameter at the top and 0.500 inches in diameter at the lower end, so that the body fits snugly when pounded into a 0.625 inches aperture 340 in hull; however these dimensions are not strictly required and the plug may have comprise other shapes and relative dimensions in other embodiments. The body 212 of the inner plug 210 is chamfered around its top edge/face or surface 222 for ease of selectively withdrawing the plug through the air valve opening, which may be 0.75 inches; however, here too such sizing is not strictly required and the assembly 50 may have other sizes and relative dimensions in other examples. The body of the inner plug is chamfered on end 216 thereof for ease of entry into the aperture 340 in the hull 130.

Referring to FIG. 5, the indicia 234 on the inner plug 210 may enable one to determine the extent to which the plug has been inserted into the aperture because the plug features horizontal and vertical indicator lines. The indicia 234 on the inner plug 210 may enable an operator 237 of the assembly 50, seen in FIG. 15, to determine the extent to which the plug as shaft 178, seen in FIG. 5, is being dislodged after hammering on the shaft because the inner plug features horizontal and vertical indicator lines. If no movement is seen, the inner plug is likely to be solidly in place. The operator may be referred to as a rescuer who is seeking to rescue and/or prolong the life of one or more persons trapped within capsized vessel 132 seen in FIG. 15, for example.

The inner plug 210 as herein described may further enable the operator 237, seen in FIG. 15, to easily disconnect shaft 178, seen in FIG. 8, from the inner plug because the design of the malleable plug features a threaded bore 334, seen in FIG. 10, which is loosely threaded onto male threading threaded distal end portion 192 of shaft 178 seen in FIG. 5. Referring to FIGS. 5 and 8, once the inner plug 210 is held in place in the aperture 340 in the hull 130 by friction fit achieved by pounding on flange 186 of apparatus 176 before unthreading the shaft 178 from the inner plug 210, the operator 237 seen in FIG. 13 can unthread and withdraw the shaft past the valve 78 of the assembly 50, in a manner which inhibits dislodgement of the inner plug from the aperture in the hull.

Referring to FIG. 5, the plug insertion apparatus 176 may reduce the prospects of air escaping during insertion of inner plug 210 and subsequent partial removal of the valve 78 and the upper chamber 56 seen in FIG. 1. When preparing for salvage or tow operations, the assembly 50 as herein described used via the following steps may re-seal the vessel in a more fail-safe manner: 1) plug the aperture 340 in the hull 130, seen in FIG. 8; 2) remove the valve 78 and upper chamber 56 of the assembly 50 seen in FIG. 16; and 3) seal or plug the lower chamber 92 which remains fastened to the hull with outer plug 116 installed into the top of the lower chamber as seen in FIG. 18.

As seen in FIG. 5, the shaft 178 is provided already inserted into a dedicated cap 194 with sealing O-rings 206 and 208. This cap replaces the cap 70 seen in FIG. 2 during installation of the inner plug 210 seen in FIG. 5. The operator 237 seen in FIG. 13 installs the inner plug by lowering shaft 178, seen in FIG. 5, until the tapered plug enters the aperture 340 in the hull 130, seen in FIG. 8, then pounds on the flange 186 seen in FIG. 5 to embed the inner plug. The air-lock capabilities of the assembly 50 as herein described may thus function to inhibit air escape.

The plug insertion apparatus 176 as seen in FIG. 5 and as herein described, and method of using the plug insertion apparatus, may enable installation of inner plug 210 seen in FIG. 8 into aperture 340 of hull 130 while inhibiting escape of air throughout process, in preparation for towing or other salvage operations. The apparatus may provide for a more reliable installation of a low-profile plug assembly, as the operator can remove upper stages of assembly (valve and upper chamber) with little chance of dislodging the inner plug 210.

Figure 19:
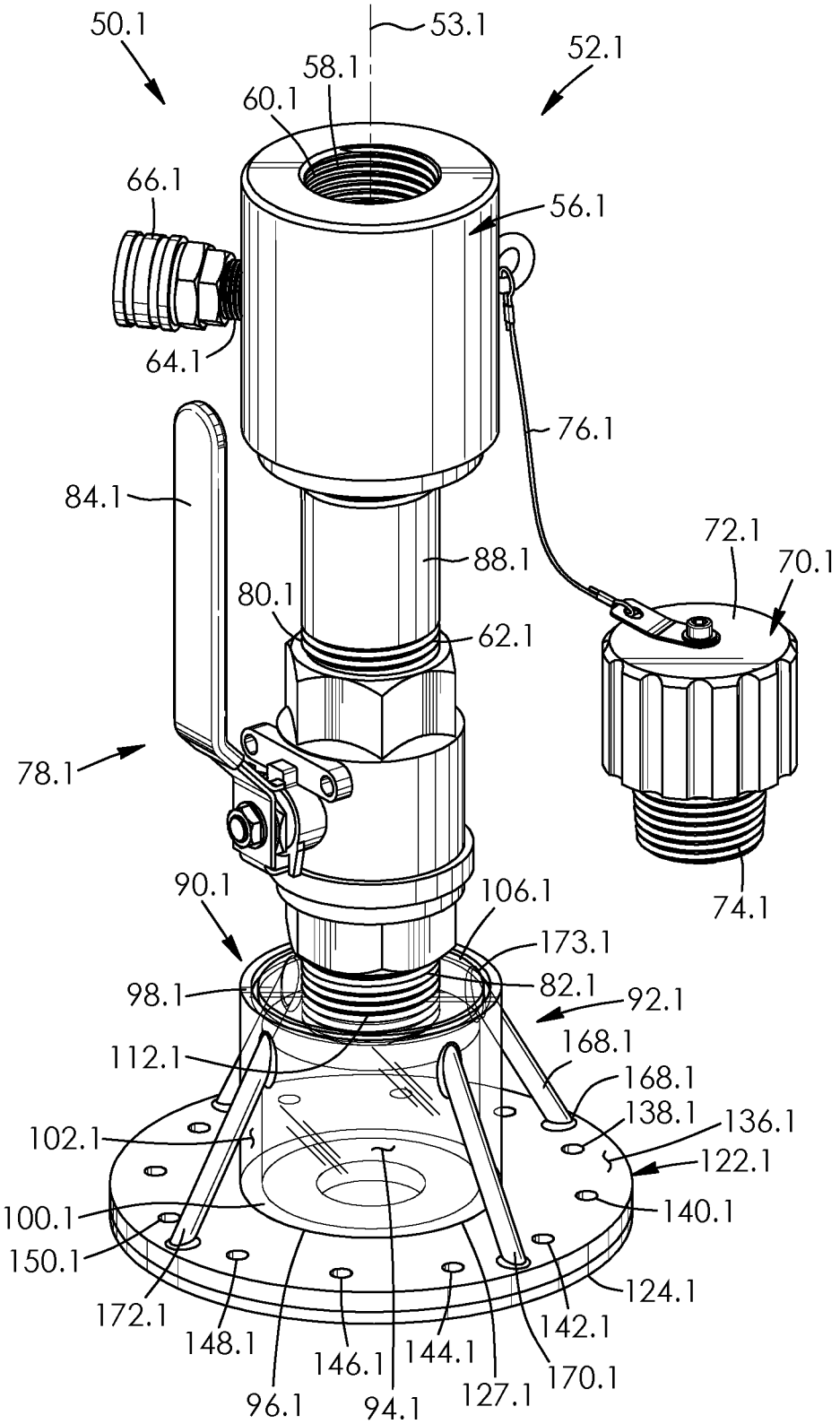
FIG. 19 is a front, top perspective view of a hull penetration apparatus of a hull penetration assembly according to a second aspect, with an outer cover of the hull penetration apparatus being removed.

FIG. 19 shows a hull penetration assembly 50.1 according to a second embodiment. Like parts have like numbers and function as the embodiment shown in FIGS. 1 to 18 with the addition of decimal extension ".1". Assembly 50.1 is substantially the same as assembly 50 shown in FIGS. 1 to 18 with the exception that the lower chamber 92.1 of the hull penetration mount 90.1 is made of a transparent material and is thus transparent. This may enable the operator to monitor the markings of the inner plug 210 seen in FIG. 5, and thereby better determine the extent to which the inner plug is fully inserted into the aperture of the hull and secured in place, for example. The assembly 50.1 as herein described may further enable the operator to visually inspect and determine what is happening at the drill site.

Figure 20:
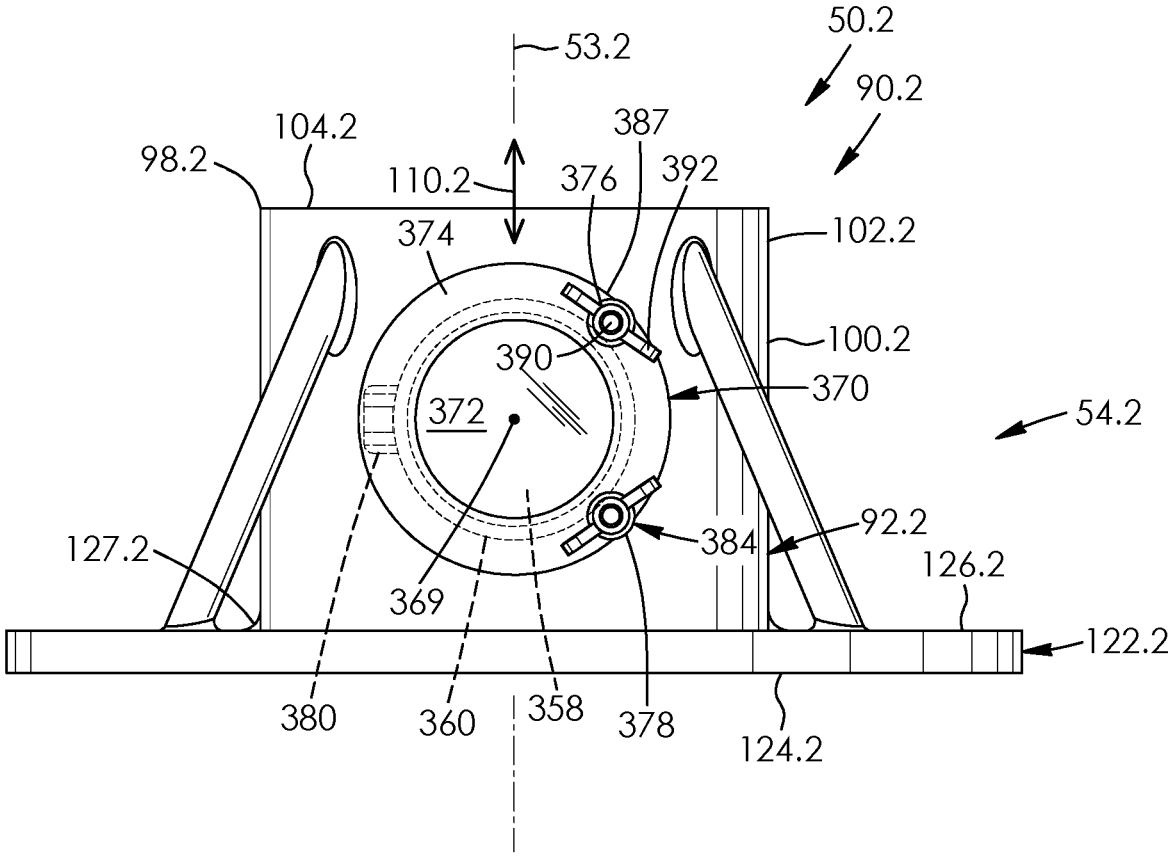
FIG. 20 is a front elevation view of a hull penetration mount of a hull penetration apparatus of a hull penetration assembly according to a third aspect, the hull penetration mount including a hatch shown in a closed position.

FIGS. 20 to 22 show a hull penetration mount 90.2 of a hull penetration assembly 50.2 according to a third embodiment. Like parts have like numbers and functionings as the embodiment shown in FIGS. 1 to 18 with the addition of decimal extension ".2". Hull penetration mount 90.2 and hull penetration assembly 50.2 are substantially the same as hull penetration mount 90 and hull penetration assembly 50 shown in FIGS. 1 to 18 with the following exceptions.

Referring to FIG. 22, the central conduit, in this example lower chamber 92.2 has an opening, in this example an access port 358. The access port is circular in this example; however, this is not strictly required and the access port may comprise other shapes in other embodiments. The access port 358 is positioned between the lower end 96.2 and upper end 98.2 of the lower chamber 92.2. The access port extends from the exterior 100.2 to the interior 94.2 of the lower chamber.

As seen with reference to FIGS. 21 to 22, the hull penetration mount 90.2 includes an auxiliary conduit 360 extending about the opening 358 of the lower chamber 92.2. The auxiliary conduit is tubular in this example; however this is not strictly required and the conduit may comprise other shapes in other embodiments. Referring to FIG. 21, the auxiliary conduit has a proximal end 362 that couples to the exterior surface 102.2 of the lower chamber via welding 363 in this example. The auxiliary conduit 360 has a distal end 364 which is radially spaced outwards from the proximal end thereof, relative to axis 53.2 of the assembly 50.2. The auxiliary conduit has an annular exterior surface 368 which extends between the ends 362 and 364 thereof, and extends along and about a longitudinal axis 369. As seen with reference to FIGS. 21 to 22, the auxiliary conduit 360 is in fluid communication with and extends radially outwards from the lower chamber 92.2 and longitudinal axis 53.2 of the assembly 50.2.

Referring to FIG. 20, the mount 90.2 includes hatch 370 which selectively extends across and covers the access port 358. The hatch may be referred to as an inspection hatch and is generally disc-shaped in this example. The hatch 370 includes a window 372 in this case, with the hatch thus being transparent at least in part. The hatch includes a peripheral portion 374 that is annular in this example and which extends about the window thereof. The hatch 370 has a plurality of inwardly-extending recesses 376 and 378 positioned along the peripheral portion thereof.

As seen in FIG. 22, the hatch hingedly connects to the auxiliary conduit 360 in this embodiment via hinge 380. Referring to FIG. 21, the hinge in this example is welded to the exterior surface 368 of the auxiliary conduit adjacent to the distal end 364 of the auxiliary conduit. The hatch 370 has a closed position seen in FIG. 20 in which the hatch extends over and seals the access port 358 of the lower chamber 92.2. The hatch extends perpendicular to the axis 369 of the conduit 360 in the closed positioned in this example. The hatch 370 is moveable from the closed position to an open position seen in FIGS. 21 and 22. The hatch extends parallel with the longitudinal axis 369 of the conduit 360 when in the open position.

Referring to FIG. 22, the mount 90.2 includes a locking mechanism, in this example in the form of a plurality of latches 382 and 384 which pivotally connect to the auxiliary conduit 360 in this embodiment via hinge 386 and 388; the locking mechanism as herein described is not strictly required and other locking mechanisms may be used in other embodiments. As seen in FIG. 21, the hinge 386 of each latch 382 is welded to the exterior surface 368 of the auxiliary conduit adjacent to the distal end 364 of the auxiliary conduit. Each latch includes in this example a male threaded member, in this case a threaded shaft 390 to which its corresponding hinge 386 couples. Each latch 382 includes in this example a female threaded member, in this case a wingnut 392 threadably coupled to and thus position-adjustable relative to its shaft.

Referring back to FIG. 22, the latches 382 and 384 have open positions in which the shafts 390 thereof extend radially outwards from the conduit 360 and perpendicular to the longitudinal axis 369 of the conduit in this example. The latches are moveable from their open positions to closed positions seen in FIG. 20. The latches 382 and 384 in said closed positions extend parallel with the longitudinal axis of the conduit 360 in this example. The shafts 390 of the latches extend within respective recesses 376 and 378 of the hatch 370 when the latches are in their closed positions, with the wingnuts 392 thereof shape to abut the hatch. The latches 382 and 384 inhibit opening of the hatch thereby.

Referring to FIG. 22, the hatch 370 may be selectively opened to access the interior 94.2 of the lower chamber 92.2 for removing any problematic debris 394 arising from drill bit 344.2 via pliers 396, in this example. The hatch is thus selectively removable from the access port 358 of the lower chamber 92.2, with the interior of the lower chamber being accessible thereby. The assembly 50.2 as herein described may thus enable operator 237.2 to pull waste out of the lower chamber manually through the opened port.

Assembly 50.2 as herein described may enable monitoring of drilling and plug insertion processes including enabling one to visually inspect the drill site during drilling. This may enable the operator to determine if excess waste is accumulating within the interior 94.2 of the chamber 92.2 or if the drill bit needs raising and lowering to ease the drilling process, for example. The access port and hatch may be referred to as a hinged porthole, which so configured may be easy to close swiftly without need of a tether to couple the hatch to the rest of the assembly.

Assembly 50.2 so configured may enable the operator to alternatively remove via the access port 358 cutting waste, debris and the like, from the lower chamber 92.2, by blasting air through air port 64, seen in FIG. 2, and into the lower chamber. Referring to FIG. 22, the assembly may enable the operator 237.2 via the access port 358 to lubricate the drill bit 344.2 during drilling operations. Assembly 50.2 as herein described may further enable the operator to determine if the inner plug 210 seen in FIG. 5 has been and remains properly inserted in the aperture of the hull.

Figure 24B:
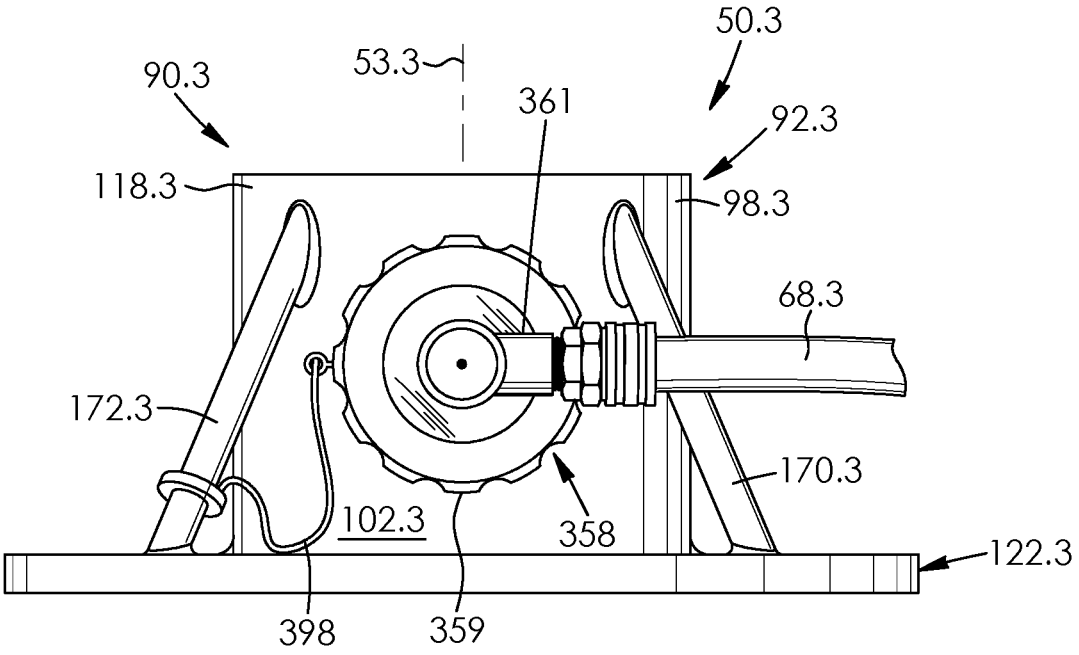
FIG. 24*b* is a front elevation plan view of the hull penetration mount of FIG. 23 with a hatch thereof removed and an air injection hose coupled to an access port thereof.

FIGS. 23 to 24*b* show a hull penetration mount 90.3 of a hull penetration assembly 50.3 according to a fourth embodiment. Like parts have like numbers and functionings as the embodiment shown in FIGS. 20 to 22 with decimal extension ".3" replacing decimal extension ".2" and with decimal extension ".3" being added for parts not previously having decimal extensions. Hull penetration mount 90.3 and hull penetration assembly 50.3 are substantially the same as hull penetration mount 90.2 and hull penetration assembly 50.2 shown in FIGS. 20 to 22 with the following exceptions.

Referring to FIG. 23, the exterior surface 368.3 of the auxiliary conduit 360.3 is threaded in a direction extending from the distal end 364.3 of the conduit towards the proximal end of the conduit. Hatch 370.3 threadably connects to and is selectively removable from the conduit 360.3 so threaded.

As seen in FIG. 24*a*, the peripheral portion 374.3 of the hatch is shaped to promote gripping thereof, in this example in the form of a plurality of circumferentially spaced-apart recesses 376.3 and 378.3 which facilitate gripping of the hatch to threadably connect or remove the same from the conduit. The hatch 370.3 couples to a brace, in this example bar 172.3 via a tether 398. Hatch 370.3 may be simpler to fabricate and operate compared hatch 370.2 seen in FIGS. 20 to 22.

The assembly 50.3 so configured further enables an operator to deliver air into the air pocket of the capsized vessel via a threaded low-profile fitting on a side of the lower chamber during salvage operations. This may be by injecting and venting air through the access port 358 as seen in FIG. 24*b*. Hatch 370.3 seen in FIG. 23 is threadably removed and air injection hose 68 seen in FIG. 24*b* is threaded onto the access port 358 via a coupler, in this example threaded pipe adapter 359 to which a quick-connect fitting 361 couples.

FIGS. 25 to 28 show an object delivery apparatus 400 of a hull penetration assembly 50.4 according to a fifth embodiment for a person 464 trapped within a capsized vessel 132.4. Like parts have like numbers and functionings as the embodiment shown in FIGS. 1 to 18 with decimal extension ".4" being added for parts not previously having decimal extensions. Hull penetration assembly 50.4 is substantially the same as hull penetration assembly 50 shown in FIGS. 1 to 18 with the exception that the former further includes the object delivery apparatus 400 as described below.

Figure 25:
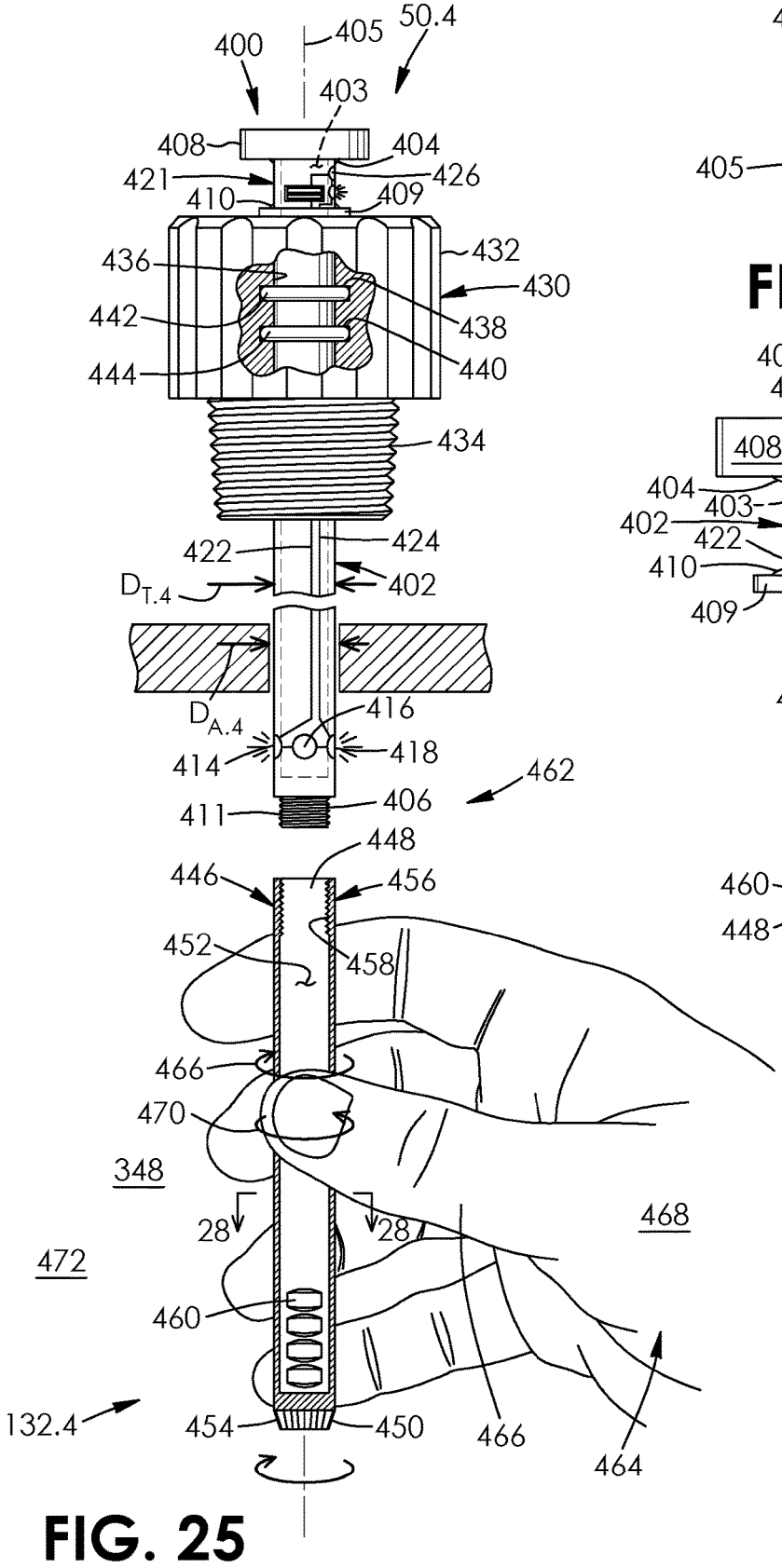
FIG. 25 is an exploded, partially sectional, front elevation view of an object delivery apparatus of a hull penetration assembly according to a fifth aspect.
Figure 26:
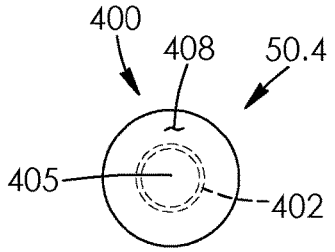
FIG. 26 is a top plan view of a stop collar of the object delivery apparatus of FIG. 25.

Referring to FIG. 25, the object delivery apparatus includes an elongate member, in this example a hollow tube 402. The tube has a first or proximal end 404, a second or distal end 406 spaced-apart from the proximal end thereof, and a longitudinal axis 405 which aligns with and extends between the ends thereof. The tube 402 is shaped to be insertable through the aperture 340 of the hull 130 of the vessel 132 seen in FIG. 8. The tube includes a distal end portion, in this example a threaded distal end portion 411 which extends from the distal end 406 thereof towards the proximal end 404 thereof.

As seen in FIG. 25, the object delivery apparatus 400 includes a pair of enlarged portions, in this example a stop collar 408 and flange 409 longitudinally spaced-apart from the stop collar. The stop collar selectively couples to the tube 402, in this example threadably coupling to the tube adjacent to the proximal end 404 of the tube. The flange couples to the tube in this example via welding 410. The stop collar 408 and flange 409 are each cylindrical in shape in this example and extend radially outwards from the tube 402 and axis 405. The stop collar and flange are larger than the aperture 340 of the hull 130 seen in FIG. 8, thereby functioning to inhibit the object delivery apparatus 400 as a whole from inadvertently slipping through the aperture of the hull.

Figure 27:
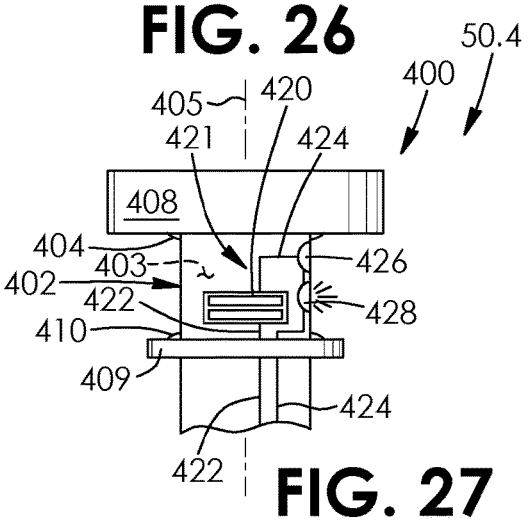
FIG. 27 is an enlarged, schematic elevation view an upper end portion of the object delivery apparatus of FIG. 25.
Figure 28:
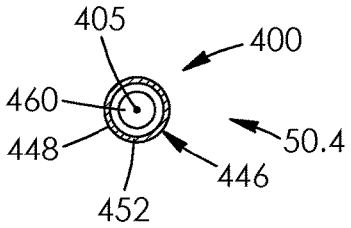
FIG. 28 is a sectional view taken alone lines 28-28 of the object delivery apparatus of FIG. 25.

The object delivery apparatus 400 includes one or more lights, in this example a plurality of lights, in this case LED lights 414, 416 and 418 coupled to the tube 402 adjacent to the distal end 406 of the tube. The lights are circumferentially spaced-apart about the tube in this example. As seen in FIG. 27, the object delivery apparatus includes a power source, in this example a battery 420 positioned within the interior 403 of the tube 402 adjacent to the proximal end 404 of the tube in this example. As seen in FIG. 25, the lights 414, 416 and 418 electrically connect to the battery via circuitry 421. The circuitry comprises a pair of conductors 422 and 424 and a switch, in this example a push button switch 426. The push button switch is located adjacent to the proximal end 404 of the tube 402 in this example.

Referring to FIG. 27, actuation of the push button switch 426 closes the circuit and thereby provides power to the lights 414, 416 and 418 shown in FIG. 25. As seen in FIG. 27, the circuitry 421 further includes an indicator light, in this example an LED indicator light 428 adjacent to the push button switch 426. Closing of the circuit also causes the indicator light to power on. The push button switch 426 and indicator light 428 are positioned between the stop collar 408 and flange 409 in this example. Batteries, push button switches and LED lights are known per se to those skilled in the art and their various parts and functionings will thus not be described in further detail.

Referring back to FIG. 25, the object delivery apparatus 400 includes a threaded cap 430. The cap includes a grippable portion 432 and a male threaded portion 434 coupled to the grippable portion in this example. The cap 430 has a bore 436 through which the tube 402 slidably extends. The cap has a pair of axially spaced-apart annular grooves 438 and 440 which are in fluid communication with and which extend radially outwards from the bore. The cap 430 includes a pair of sealing members, in this example O-rings 442 and 444. The tube 402 is shaped to slidably and sealably extend through and be moveable relative to the cap 430 thereby. The threaded portion 434 of the cap is shaped to selectively threadably couple with the female threaded portion 60 of the upper chamber 56 as seen in FIG. 2. Cap 430, seen in FIG. 25, is shaped to seal the top 52 of the hull penetration assembly 50 seen in FIG. 1 when so coupled to the upper chamber 56 of the assembly. Referring back to FIG. 25, flange 409 is shaped to inhibit the cap 430 from inadvertently engaging with the push button switch 426.

The object delivery apparatus 400 includes a releasable member, in this example a removable conduit, in this case a container 446. The container is tubular in this example and has a first or proximal open end 448, a second or distal closed end 450 and an interior 452 extending between the ends thereof. The lights 414, 416 and 418 are adjacent to the open end of the container in this example. The closed end 450 of the container is in this example knurled with a plurality of protrusions, in this case longitudinally-extending, gripping ridges 454.

The container 446 includes a proximal female end portion, in this example proximal female threaded end portion 456 extending from the open end 448 thereof towards the closed end 450 thereof. The female threaded end portion of the container includes a bore, in this example a threaded bore 458. The female threaded end portion 456 of container 446 threadably couples with and receives threaded distal end portion 411 of tube 402. The container thus connects to the distal end 406 of the tube. The distal end of the tube 402 is shaped to loosely threadably connect to the container.

Still referring to FIG. 25, the container 446 is shaped to hold an object therein, in this example in the form of a food energy source, in this case a plurality of energy tablets 460. The container is configured to align with and be coaxial with the longitudinal axis 405 of the tube 402 when coupled thereto in this example.

The object delivery apparatus 400 thus includes a release mechanism 462, in this example comprising threaded bore 458 of container 446 and threaded distal end portion 411 of tube 402, via which the container and thus the energy tablets may be selectively separated from the tube and delivered to person 464 trapped underneath capsized vessel 132.4 and in need of rescue. The release mechanism in this embodiment is thus in the form of the container 446 threadably connecting to and being removable from the distal end 406 of the tube adjacent to the open end 448 of the container. The distal end of the tube 402 of the object delivery apparatus 400 is therefore selectively connectable with the object, in this example container 446 and tablets 460.

In operation, to deliver an object to person 464 caught within the interior 348 of the capsized vessel 132.4, aperture 340 is first drilled through the hull of the capsized vessel as described in FIGS. 8 and 12. The handle 84 of valve 78 seen in FIG. 1 is next moved to a closed position to inhibit air from the interior of the vessel from escaping as seen in FIG. 13. Referring to FIG. 25, energy tablets 460 are next inserted into the interior 452 of the container 446 via the open end 448 of the container. The container is next coupled to the distal end 406 of tube 402, in this example by rotating the container in a first rotational direction 466 relative to the tube and threadably coupling together the container and tube. End cap 70 seen in FIG. 1 is next removed and cap 430, seen in FIG. 25, is next threadably coupled to the upper chamber 56 seen in FIG. 1. The handle 84 of valve 78 is next moved to an open position as seen in FIG. 15. Referring back to FIG. 25, tube 402 is next inserted through the aperture 340 in the hull 130 seen in FIG. 8 such that the energy tablets 460, seen in FIG. 25, are positioned within the interior 348 of the capsized vessel 132.4. The tube is shaped to extend through the aperture of the hull of the vessel such that the container 446 is positioned within the interior 348 of the capsized vessel, with the proximal end 404 of the tube remaining outside of and spaced-apart from the interior of the vessel.

Thereafter, the release mechanism 462 of the object delivery apparatus 400 is actuated by the hand 468 of the person 464 trapped inside the vessel 132.4, in this example by rotating the container 446 in a second rotational direction 470 which is opposite the first rotational direction 466. In this manner, the container and energy tables are separated from the tube and delivered to the person.

Assembly 50.4, with its object delivery apparatus 400 as herein described, enables repeated delivery of objects, such as small amounts of food, medicine, messages, a flashlight, water and the like, to conscious trapped persons 464. The assembly, with its object delivery apparatus 400 as herein described, may thus help keep victims alive longer by allowing the rescuer to deliver water, nutrition, medication and other necessaries of life including light into air pocket on the one hand, while inhibiting escape of air therefrom on the other hand. Container 446 is re-usable, with objects to be delivered packed in one or more sets of the same. The lights 414, 416 and 418 seen in FIG. 25 function to provide long-term light inside the air pocket 472 formed by the capsized vessel 132.4, facilitating self-rescuing actions and inhibiting panic on the part of person 464. The container 446 is thick-walled in this example for strength and to facilitate cutting threads.

Figure 29:
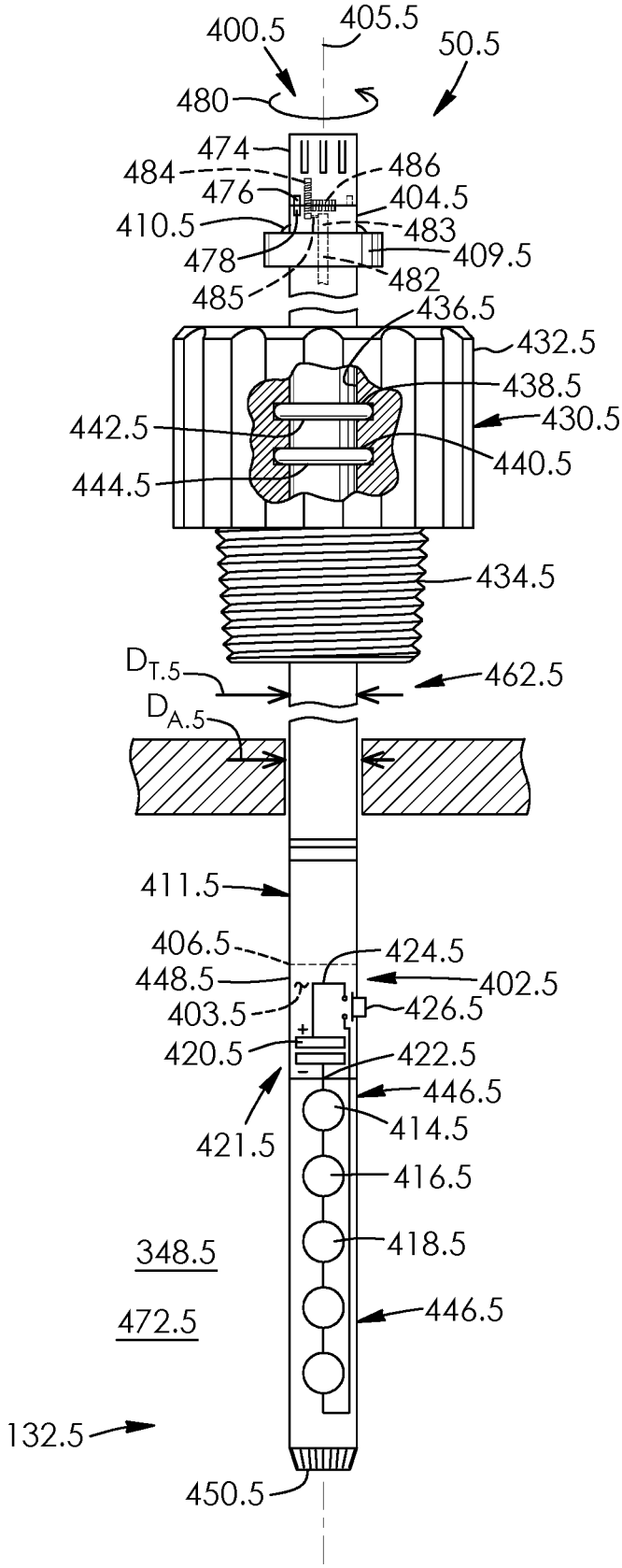
FIG. 29 is an exploded, partially sectional, front elevation view of a light delivery apparatus of a hull penetration assembly according to a sixth aspect, the light delivery apparatus including a hand-graspable flashlight and a release mechanism in the form of a push rod.
Figure 30:
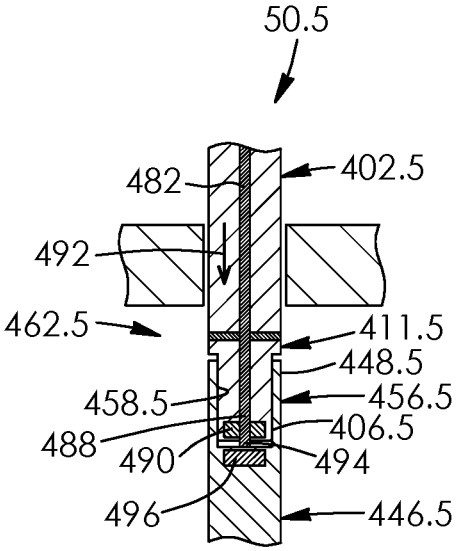
FIG. 30 is a fragmented, enlarged schematic view of the release mechanism of the light delivery apparatus of FIG. 29, with the push rod shown in a retracted position.
Figure 31:
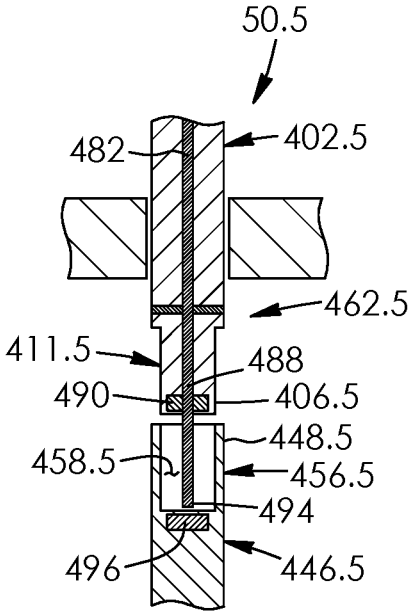
FIG. 31 is a fragmented, enlarged schematic view of the release mechanism of the light delivery apparatus of FIG. 29, with the push rod shown in an extended position and in the process of releasing the hand-graspable flashlight.

FIGS. 29 to 31 show an object delivery apparatus, in this example a light delivery apparatus 400.5 of a hull penetration assembly 50.5 according to a sixth embodiment for a person trapped within a capsized vessel 132.5. Like parts have like numbers and functionings as the embodiment shown in FIGS. 25 to 28 with decimal extension ".5" replacing decimal extension ".4" and decimal extension ".5" being added for parts not previously having decimal extensions. Hull penetration assembly 50.5 is substantially the same as hull penetration assembly 50 shown in FIGS. 1 to 18 with the exception that the former further includes the light delivery apparatus 400.5 as described below.

As seen in FIG. 29, the release mechanism 462.5 includes an actuator, in this example a knob 474 that rotatably couples to tube 402.5 about longitudinal axis 405.5 of the tube. The knob is adjacent to the proximal end 404.5 of the tube in this example. The knob 474 has a locked position seen in FIG. 29 in which indicia 476 thereon aligns with corresponding indicia 478 on the tube. The knob is moveable from the locked position to a released position by rotating the knob in a first rotation direction, as seen by arrow of numeral 480. This causes the indicia 476 and 478 to be circumferentially spaced-apart.

As seen in FIG. 29, the release mechanism 462.5 includes a push rod 482 aligned with and extending parallel to axis 405.5 of tube 402.5. The push rod has a first or proximal end 483. The release mechanism 462.5 includes a worm gear 484 in this example which couples to the proximal end of the push rod 482 via a radially outwardly extending link member 485. The release mechanism includes a worm wheel 486 and knob 474 which are coupled together and which rotatably couple to the worm gear 484. The worm wheel and worm gear convert rotational motion of the knob 474 to linear motion of the push rod 482.

Referring to FIG. 30, the push rod 482 has a second or distal end 488. The push rod has a retracted position seen in FIG. 30. The light delivery apparatus 400.5 includes a ferromagnetic member, in this example magnet 490 adjacent to the distal end of the push rod. The magnet extends about and is slidable relative to the push rod.

As seen in FIG. 29, the light delivery apparatus 400.5 includes a releasable member in the form of a hand-graspable flashlight 446.5. The flashlight is buoyant in this example and may referred to as a light stick. The flashlight 446.5 in this example comprises one or more lights, in this case a plurality of longitudinally spaced-apart lights 414.5, 416.5, and 418.5, together with circuitry 421.5 and a battery 420.5 therein, and a push button switch 426.5 thereon for selectively turning on the lights.

As seen in FIG. 30, the distal end portion, in this example the male distal end portion 411.5 of tube 402.5, is smaller in radius relative to the rest of the tube. The proximal female end portion 456.5 of the flashlight is shaped to receive the male distal end portion of the tube when the push rod 482 is in its retracted position. The flashlight 446.5 includes a ferromagnetic member, in this example a magnet 496 adjacent to the proximal female end portion 456.5 thereof and adjacent to magnet 490 when the push rod in its retracted position seen in FIG. 30. The flashlight thus magnetically connects to the distal end 406.5 of the tube 402.5.

Rotation of the knob 474 seen in FIG. 29 from the locked position thereof towards the released position thereof causes the push rod 482 to move longitudinally downwards relative to FIGS. 29 to 31 from its retracted position seen in FIG. 30 to an extended position in FIG. 31. This movement is shown in FIG. 30 by arrow of numeral 492. This causes the distal end 494 of the push rod 482 to abut proximal female end portion 456.5 of the flashlight 446.5 such that the magnetic force of attraction between magnets 490 and 496 is overcome and the flashlight 446.5 is released from the tube 402.5 for the person trapped inside the capsized vessel 132.5 to grasp, for example.

The distal end 494 of the push rod 482 in its fully extended position seen in FIG. 31 is axially spaced-apart from the distal end 406.5 of tube 402.5 and spaced-apart from magnet 490. The push rod so actuated thus abuts the flashlight and causes the flashlight to be released from the tube.

In operation, to deliver the flashlight 446.5 to a person caught within the interior 348.5 of the capsized vessel 132.5, the aperture 340 is first drilled through the hull of the vessel as described in FIGS. 8 and 12. Referring to FIG. 29, the flashlight is next magnetically coupled to tube 402.5. The handle 84 of valve 78 seen in FIG. 1 is next moved to a closed position to inhibit air from the interior of the vessel from escaping as seen in FIG. 13. End cap 70 seen in FIG. 1 is next removed and cap 430.5, seen in FIG. 29, is next threadedly coupled to the upper chamber 56 seen in FIG. 1. The handle 84 of valve 78 is next moved to towards an open position as seen in FIG. 14 and arrow of numeral 346. Referring to FIG. 29, tube 402.5 is next inserted through the aperture 340 in the hull 130 seen in FIG. 8 such that the flashlight 446.5, seen in FIG. 29, is positioned within the interior 348.5 of the capsized vessel 132.5. The tube 402.5 is shaped to extend through the aperture of the hull of the vessel such that the flashlight is positioned within the interior 348.5 of the capsized vessel 132.5, with the proximal end 404.5 of tube 402.5 remaining outside of and spaced-apart from the interior of the vessel. Thereafter, the release mechanism 462.5 of the light delivery apparatus 400.5 is actuated by rotating knob 474 in rotational direction 480 seen in FIG. 29. In this manner, the push rod 482 seen in FIGS. 30 and 31 is selectively moved linearly downwards and flashlight 446.5 is released from the tube 402.5 and into the air pocket 472.5 of the vessel 132.5 seen in FIG. 29.

Assembly 50.5, with its light delivery apparatus 400.5 as herein described, enables delivery of buoyant illumination devices with no cooperation required by conscious survivors, enhancing rescue or salvage operations. The assembly as herein described provides the advantage of enabling an operator to illuminate the air pocket 472.5 of the vessel 132.5 and continue to have the interior 348.5 illuminated thereafter for other tasks, regardless of whether the person to be rescued is conscious and regardless of the ability and state of the person to be rescued, by simply releasing the flashlight 446.5 into the interior 348.5 of the capsized vessel 132.5. One or more said flashlights may be released into the air pocket 472.5. The inserted buoyant flashlights 446.5 are shaped to float on the surface of the water located adjacent the air pocket, thereby providing illumination for survivors. The light may provide a beacon for subsequent dive operations, if such operations are deemed necessary, helping divers to locate, enter and operate in the air pocket. Such light may benefit survivors' morale and their ability to take self-rescue actions.

Figure 32:
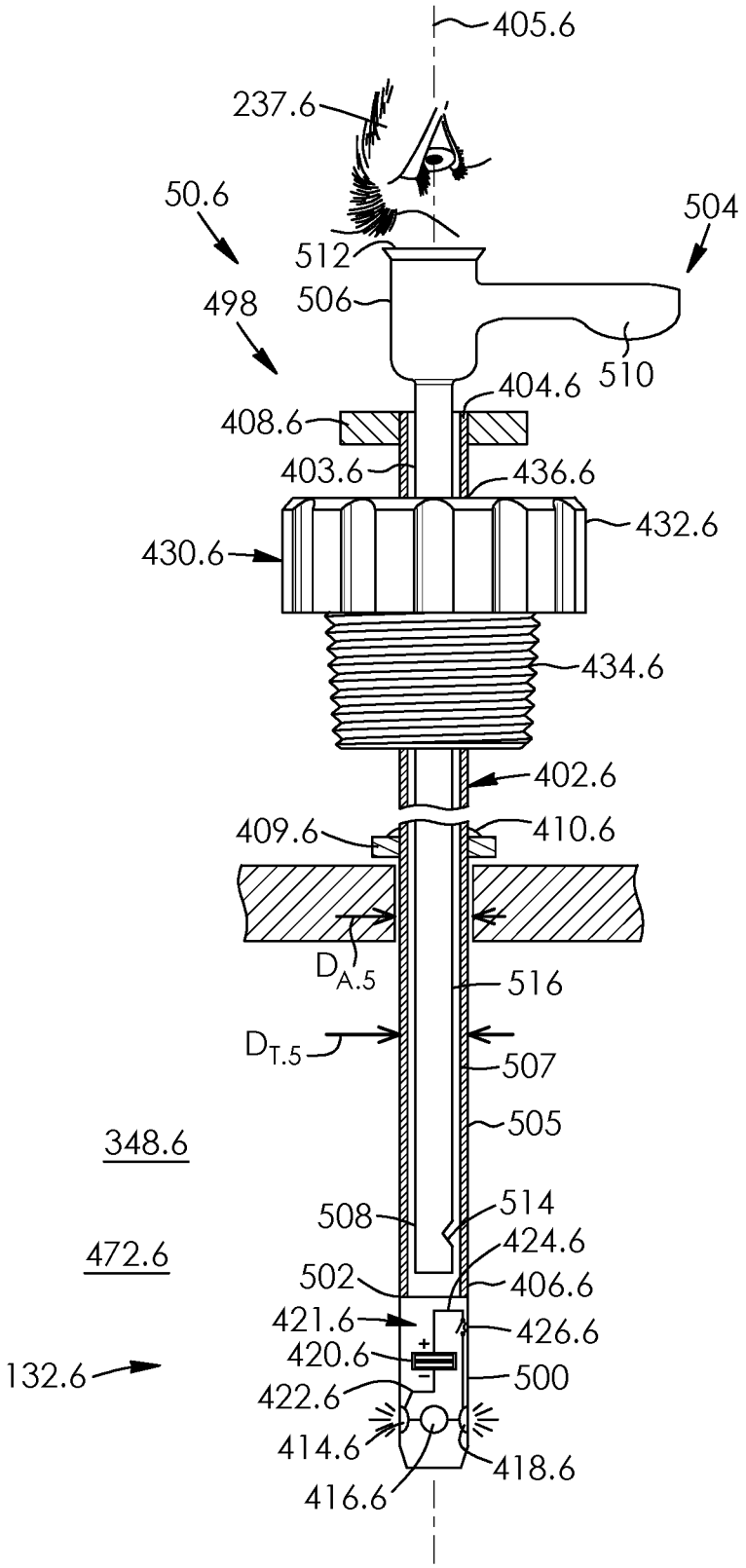
FIG. 32 is an exploded, partially sectional, front elevation view of a borescope apparatus of a hull penetration assembly according to a seventh aspect.

FIG. 32 shows a borescope insertion apparatus 498 of a hull penetration assembly 50.6 according to a seventh embodiment for rescuing a person trapped within a capsized vessel 132.6. Like parts have like numbers and functionings as the embodiment shown in FIGS. 25 to 28 with decimal extension ".6" replacing decimal extension ".4" and decimal extension ".6" being added for parts not previously having decimal extensions. Hull penetration assembly 50.6 is substantially the same as hull penetration assembly 50 shown in FIGS. 1 to 18 with the exception that the former further includes the borescope insertion apparatus 498 as described below.

Tube 402.6 is primarily made in this example of metal, in this case stainless steel; however this is not strictly required and other materials may be used in other embodiments. The tube has in this example a proximal end 404.6 that is open. The tube includes a lower portion 505 that is transparent and made of clear polycarbonate. The tube 402.6 is thus transparent at least in part. The lower portion 505 of the tube 402.6 couples to the rest of the tube via adhesive 507 in this example. However this is not strictly required as, for example, in other embodiments the tube 402.6 as a whole may be made of a transparent material rather than having a portion of the tube that is made of metal and a portion that made of transparent material.

The borescope insertion apparatus 498 includes a light housing 500 coupled to the distal end 406.6 of tube 402.6 via welding 502 in this example. Circuitry 421.6 and battery 420.6 are positioned within the housing. Push button switch 426.6 and at least one light, in this example a plurality of circumferentially spaced-apart lights 414.6, 416.6 and 418.6, are mounted to the housing 500. The battery selectively supplies power to the lights by actuating the push-button switch.

The borescope insertion apparatus 498 in this example includes a borescope 504; however this is not strictly required and in other embodiments the borescope insertion apparatus may be used with an off-the-shelf borescope. The borescope has a first or proximal end 506 and a second or distal end 508. The borescope 504 includes a gripping member, in this example a handle 510 adjacent to the proximal end thereof. The handle extends radially outwards from the longitudinal axis 405.6 of the tube 402.6 in this example. The borescope 504 includes an eyepiece 512 adjacent to the proximal end 506 thereof. The borescope includes a borescope lens 514 adjacent to the distal end 508 thereof. The borescope 504 includes a viewing passage, in this example a conduit 516 which extends from the eyepiece 512 to the borescope lens and which enables light rays to pass therebetween. Tube 402.6 is shaped to receive the conduit therewithin.

In operation, aperture 340 is first drilled through the hull of the vessel as described in FIGS. 8 and 12. The handle 84 of valve 78 seen in FIG. 1 is next moved to a closed position to inhibit air from the interior of the vessel from escaping as seen in FIG. 13. End cap 70 seen in FIG. 1 is removed and cap 430.6, seen in FIG. 32, is threadably coupled to the upper chamber 56 seen in FIG. 1. The handle 84 of valve 78 is next moved to an open position as seen in FIG. 14 and arrow of numeral 346. Referring to FIG. 32, tube 402.6 is inserted through the aperture 340 in the hull 130 seen in FIG. 8 such that the lights 414.6, 416.6 and 418.6 and borescope lens 514, seen in FIG. 32, are positioned within the interior 348.6 of the capsized vessel 132.6.

As seen in FIG. 32, the tube 402.6 is shaped to extend through the aperture of the hull of the vessel such that the lights and borescope lens are positioned within the interior of the capsized vessel, with the proximal end 404.6 of tube 402.6 remaining outside of and spaced-apart from the interior of the vessel. The borescope is thus inserted into the top end 404.6 of the tube 402.6 and pushed down so that borescope lens 514 aligns with the clear portion 505 of the tube. The operator 237.6 can then rotate the borescope or the control head thereof to scan the interior 348.6 of the air pocket 472.6. In this manner the operator 237.6 may view the interior 348.6 of the capsized vessel 132.6 and make subsequent informed decisions regarding how best to proceed going forward based on said visual inspection.

The borescope 504 includes video recording and transmission functions in this example and thus enables visual or video inspection of the air pocket 472.6. The lights 412.6, 414.6 and 416.6 function to illuminate the air pocket so that the borescope 504 need not have its own illumination source. The outer diameter $D_T$ of the tube 402.6 is slightly less than the diameter $D_A$ of the aperture in hull, so that air can be injected into the air pocket or vented from the air pocket while the tube is in place.

The borescope insertion apparatus 498 may further be used with a portable "flashlight" style inspection camera so it looks down into the tube 402.6 to focus on a mirror mounted inside the tube at the bottom end 406.6 of the clear portion 505 of the tube. In this case the mirror is angled and shaped in a convex manner if necessary so as to reflect an image of the interior of the air pocket.

The borescope insertion apparatus further enables visual or video inspection of the air pocket using any standard borescope device that fits inside the inside diameter of the tube 402.6. This is a critically important function affecting the safety and effectiveness of the rescue operation by enabling responders: a) to verify whether there are survivors in the air pocket (possibly precluding the need for a potentially dangerous rescue diver operation if there are no survivors), e.g. to detect survivors who may be unable to signal that they are in the air pocket due being unconscious, hypothermic or otherwise compromised; b) to assess conditions in the air pocket for potential hazards (e.g. presence of fish nets or other entrapment hazards) for subsequent dive rescue operations; c) to guide survivor self-rescue actions, e.g. by instructing them to raise themselves above the water line by climbing up visually identified structures inside the air pocket; and d) to identify access opportunities and encumbrances for divers. All the above functionality may be achieved while inhibiting escape of existing air within the air pocket.

It will be appreciated that many variations are possible within the scope of the invention described herein. For example, various parts as herein described have been described as coupling together via welding; this is not strictly required and the various parts may couple together via other means in other embodiments as would be appreciated by one skilled in the art. Also, many of the parts as herein described may be made of stainless steel; however, here too this is not strictly required and various of the parts of the assemblies as herein described may be made of other materials in other embodiments.

The hull penetration mounts as herein described may be referred to as a base plate and lower chamber assembly.

The translucent lower chamber 92.1 of hull penetration assembly 50.1 seen in FIG. 19 may, in a further variation, include an access port in the form of one of hatches 370 and 370.1 seen in FIGS. 20 and 24 for hull penetration assemblies 50.2 and 50.3, for example.

The term threaded cap as variously herein described may also be referred to as a sealing cap.

While each has been described separately, the plug insertion apparatus 176 of FIG. 5, the object delivery apparatus 400 of FIGS. 25 to 28, the light delivery apparatus 400.5 of FIGS. 29 to 31 and the borescope apparatus 498 of FIG. 32 may all be provided together and sold as a single kit in the form of assembly 50 seen in FIGS. 1 to 18, assembly 50.4 seen in FIGS. 25 to 28, assembly 50.5 seen in FIGS. 29 to 31, and assembly 50.6 seen in FIG. 32.

ADDITIONAL DESCRIPTION

Examples of hull penetration assemblies, and parts and subassemblies thereof, have been described. The following clauses are offered as further description.

(1) A hull penetration mount comprising: a conduit which selectively receives a drill bit and allows passage of pressurized air therethrough; a planar base coupled to and extending radially outwards from the conduit; and a plurality of spaced-apart braces coupled to and extending between the planar base and an exterior surface of the conduit.

(2) The mount of clause 1, wherein each said brace comprise an elongate member.

(3) The mount of any one of clauses 1 to 2, wherein each said brace comprise a bar.

(4) The mount of any one of clauses 1 to 3, wherein the braces are shaped to inhibit debris from becoming entangled with the mount.

(5) The mount of any one of clauses 1 to 4 wherein each said brace has a longitudinal axis and is an isosceles trapezoid in shape in longitudinal cross-section.

(6) The mount of any one of clauses 1 to 5 wherein each said brace couples to and extends between a peripheral edge portion of the planar base and an upper portion of the conduit.

(7) The mount of any one of clauses 1 to 6 wherein the braces are circumferentially spaced-apart from each other.

(8) The mount of any one of clauses 1 to 7 wherein first and third said braces align with each other and second and fourth said braces align with each other.

(9) The mount of any one of clauses 1 to 8 wherein the planar base has a plurality of circumferentially spaced-apart apertures extending therethrough.

(10) The mount of clause 9 wherein each pair of said braces has three of said apertures positioned therebetween.

(11) A hull penetration mount comprising a conduit which selectively receives a drill and allows passage of pressurized air therethrough, the conduit being transparent at least in part.

(12) The mount of any one of clauses 1 to 11 further including an additional plug threadably connectable to an upper end of the conduit.

(13) The mount of any one of clauses 1 to 12, wherein the mount couples to an exterior surface of a hull of a vessel via the planar base and wherein the mount further includes a deformable gasket positioned between the planar base and the exterior surface of the hull.

(14) A hull penetration mount comprising: a central conduit which selectively receives a drill and allows passage of pressurized air therethrough, the central conduit having an interior, an upper end, a lower end spaced-apart from the upper end, an exterior, and an opening positioned between the ends thereof, the opening extending from the interior to the exterior thereof; and a hatch extending across and sealing the opening in a closed position, the hatch being selectively removable from said opening, with the interior of the central conduit being accessible thereby.

(15) The mount of clause 14 wherein the hatch is transparent at least in part.

(16) The mount of any one of clauses 14 to 15 wherein the hatch includes a window.

(17) The mount of any one of clauses 14 to 16 further including an auxiliary conduit extending about the opening of the central conduit, the auxiliary conduit coupling to, being in fluid communication with and extending radially outwards from the central conduit.

(18) The mount of clause 17 wherein the hatch hingedly connects to the auxiliary conduit.

(19) The mount of any one of clauses 14 to 18 further including one or more latches which inhibit movement of the hatch from said closed position.

(20) The mount of clause 18 wherein the hatch has at least one recess along a peripheral portion thereof and wherein the mount further includes at least one latch pivotally coupled to the auxiliary conduit, the latch extends radially outwards from the auxiliary conduit in an open position thereof and the latch extending within the recess of the hatch in a closed position thereof, the latch inhibiting opening of the hatch thereby.

(21) The mount of clause 17 wherein the hatch threadably connects to the auxiliary conduit.

(22) An inner plug comprising: a deformable elongate body having a longitudinal axis, a first end, a second end spaced-apart from the first end, the ends being aligned along the axis, the body extending laterally outwards from the first end towards the second end thereof, and an exterior surface; and a plurality of ridges extending about the exterior surface of the elongate body.

(23) The plug of clause 22 wherein the ridges are spaced-apart from each other.

(24) The plug of any one of clauses 22 to 23 wherein the ridges are concentric.

(25) The plug of any one of clauses 22 to 24 wherein the ridges extend from the first end of the elongate body towards the second end of the elongate body.

(26) A plug comprising: a deformable elongate body having a longitudinal axis, a first end, a second end spaced-apart from the first end, the ends being aligned along the axis, the body extending laterally outwards from the first end towards the second end thereof, and an exterior surface; and indicia extending about the exterior surface of the elongate body.

(27) The plug of clause 26 wherein the indicia includes a plurality of axially spaced-apart, laterally-extending markings extending between the first end of the body and the second end of the body.

(28) The plug of clause 26 wherein the indicia includes a plurality of circumferentially spaced-apart columns of axially spaced-apart, laterally-extending markings extending between the first end of the body and the second end of the body.

(29) The plug of any one of clauses 26 to 28 wherein the indicia includes a plurality of longitudinally-extending markings.

(30) The plug of clause 29 wherein the longitudinally-extending markings intersect with respective said laterally-extending said markings.

(31) The plug of any one of clauses 22 to 30, wherein the body is beveled at the first end thereof

(32) The plug of any one of clauses 22 to 31, wherein the body is beveled at the second end thereof.

(33) The plug of any one of clauses 22 to 32, further including a threaded member coupled to the second end of the body.

(34) The plug of clause 33 wherein the threaded member has a male threaded end portion which threadably couples to the body via a threaded bore of the body and wherein the threaded member has a female threaded end portion coupled to the male threaded end portion.

(35) The plug of clause 34 wherein the female threaded end portion includes a threaded bore which receives a plug insertion apparatus.

(36) The plug of any one of clauses 34 to 35 wherein the male threaded end portion is tapered and circular in lateral cross-section.

(37) The plug of any one of clauses 34 to 36 wherein the female threaded end portion has an exterior surface that is hexagonal in top profile.

(38) The plug of any one of clauses 22 to 37, wherein the body is made of an elastomer.

(39) The plug of any one of clauses 22 to 38, wherein the body is made of a thermoplastic.

(40) A plug insertion apparatus comprising: an elongate member having a distal end connectable with a plug, a proximal end, and a longitudinal axis extending between the ends thereof; and a planar member coupled to the proximal end of and extending laterally outwards from the elongate member.

(41) The plug insertion apparatus of clause 40 wherein the distal end of the elongate member is shaped to loosely threadably connect to the plug.

(42) The plug insertion apparatus of any one of clauses 40 to 41 wherein, when the plug is inserted into an aperture with a friction fit that inhibits the plug from being dislodged therefrom, hand-rotation of the planar member in a first rotational direction enables the elongate member to be removed from the plug.

(43) The plug insertion apparatus of any one of clauses 40 to 42 further including a first of a male threaded member and a female threaded member coupled to and adjacent to the distal end of the elongate member, said first of the male threaded member and the female threaded member threadably connecting to and being removable from a second of the male threaded member and the female threaded member of the plug.

(44) The plug insertion apparatus of any one of clauses 40 to 43 wherein the planar member is a cylinder in shape.

(45) The plug insertion apparatus of any one of clauses 40 to 44 wherein the planar member is shaped to receive pounding thereon.

(46) The plug insertion apparatus of any one of clauses 40 to 45 further including a threaded cap through which the elongate member slidably and sealably extends.

(47) A method of inserting a plug into an aperture of a hull of a vessel using a plug insertion member, the plug insertion member having an enlarged proximal end portion and a threaded distal end portion, the method comprising: threadably connecting the plug to the distal end portion of the plug insertion member by rotating the plug insertion member in a first rotational direction relative to the plug; inserting the plug into the aperture of the hull; applying a pounding force onto the enlarged proximal end portion of the plug insertion member to more fully insert the plug into the aperture of the hull; and removing the plug from the plug insertion member by rotating the plug insertion member in a second rotational direction opposite the first rotational direction.

(48) The method of clause 47 further including, prior to the inserting of the plug step, providing indicia on said plug, and for the applying a pounding step, applying a pounding onto the enlarged proximal end portion of the plug insertion member until a pre-determined marking of said indicia aligns flush with the hull.

(49) The method of clause 48, the plug having a longitudinal axis, and the method further including within the providing indicia on said plug step, providing a plurality of circumferentially spaced-apart columns of longitudinally-extending markings on said plug.

(50) The method of any one of clauses 48 to 49, further including providing a plurality of axially spaced-apart laterally-extending markings on said plug.

(51) The method of any one of clauses 47 to 50 further including, prior to the inserting of the plug step, forming a plurality of grooves about said plug.

(52) The method of clause 51, further including within the forming step, forming said grooves to be axially spaced-apart from each other.

(53) The method of any one of clauses 47 to 52 further including: coupling a conduit to the hull such that a first end of the conduit sealably coupled to the hull and the conduit extends about the aperture; and after the removing the plug step, covering a second end of the conduit, the conduit enclosing the aperture so plugged thereby.

(54) The method of clause 53 further including, within the covering step, sealing the second end of the conduit via a threaded plug.

(55) The method of any one of clauses 53 to 54 further including: providing a planar base to which the conduit couples; coupling the conduit to the hull by inserting a gasket between the planar base and the hull, and thereafter fastening the planar base to the hull; and providing one or more deflectors which extend between the planar base and the conduit, the one or more deflectors functioning to inhibit entanglement of the conduit with debris.

(56) An object delivery apparatus for a person trapped within a capsized vessel, the object delivery apparatus comprising: an elongate member having a distal end connectable with an object, the elongate member extends through an aperture of a hull of the vessel such that the object is positioned within an interior of the capsized vessel; and a release mechanism via which the object is separated from the elongate member and delivered to the person.

(57) The object delivery apparatus of clause 56 further including a threaded cap through which the elongate member slidably and sealably extends via a bore of the threaded cap, and a stop collar coupled to the elongate member adjacent to a proximal end of the elongate member, the stop collar being larger than the aperture of the hull and larger than the bore of the threaded cap.

(58) The object delivery apparatus of any one of clauses 56 to 57 further including a container within which the object is contained.

(59) The object delivery apparatus of clause 58 wherein the container threadably connects to the distal end of the elongate member.

(60) The object delivery apparatus of any one of clauses 58 to 59 wherein the container includes an open end and a closed knurled end.

(61) The object delivery apparatus of any one of clauses 56 to 57, wherein the object magnetically connects to the distal end of the elongate member.

(62) The object delivery apparatus of clause 61 wherein the release mechanism comprises a push rod moveable from a retracted position to an extended position which abuts operatively the object and causes the object to be released from the elongate member.

(63) The object delivery apparatus of clause 62 wherein the release mechanism includes an actuator adjacent to the proximal end of the elongate member, rotation of the actuator causing the push rod to move the retracted position to the extended position.

(64) The object delivery apparatus of any one of clauses 56 to 63, further including coupling one or more lights to the elongate member adjacent to the object.

(65) The object delivery apparatus of any one of clauses 56 to 64 wherein the object is a hand-graspable light.

(66) The object delivery apparatus of any one of clauses 56 to 64 wherein the object is food.

(67) The object delivery apparatus of any one of clauses 56 to 64 wherein the object comprises one or more energy tablets.

(68) A method of delivering an object to a person caught within an interior of a capsized vessel, the method comprising: drilling an aperture through a hull of the vessel; coupling the object to a distal end of an elongate member; inserting the elongate member through said aperture such that the object is positioned within the interior of the capsized vessel; and providing a release mechanism via which the object is separated from the elongate member and delivered to the person.

(69) The method of clause 68 further including the step of providing the elongate member with a stop collar adjacent to a proximal end thereof, the stop collar being larger than the aperture of the hull and being larger than a bore of a sealing cap which slidably extends through the elongate member.

(70) The method of any one of clauses 68 to 69 further including providing a container within which the object is contained.

(71) The method of clause 70 wherein the container threadably connects to the distal end of the elongate member.

(72) The method of any one of clauses 68 to 69 wherein the object magnetically connects to the distal end of the elongate member.

(73) The method of any one of clauses 68 to 72 further including coupling one or more lights to the elongate member adjacent to the object.

(74) The method of any one of clauses 68 to 73 further including providing the object in the form a hand-graspable light.

(75) The method of any one of clauses 68 to 74 further including providing the object in the form of food.

(76) The method of any one of clauses 68 to 74 further including providing the object in the form of one or more energy tablets.

(77) A borescope insertion apparatus comprising: a borescope; and an elongate tube within which the borescope is received, the elongate tube being transparent at least in part.

(78) A borescope insertion apparatus comprising: a borescope; and an elongate tube within which the borescope is received; and a threaded cap through which the tube slidably and sealably extends.

(79) The borescope insertion apparatus of clause 78 wherein the tube has a longitudinal axis and wherein the borescope insertion apparatus further includes a pair of spaced-apart stoppers between which is positioned the threaded cap.

(80) The borescope insertion apparatus of any one of clauses 77 to 79 further including one or more lights coupled to the elongate tube.

It will be understood by someone skilled in the art that many of the details provided above are by way of example only and are not intended to limit the scope of the invention which is to be determined with reference to the following claims.

What is claimed is:

1. A plug insertion apparatus configured to insert a plug into an aperture of a hull of a capsized vessel, the plug insertion apparatus comprising:

an elongate member having a distal end connectable with the plug; and a pressurized conduit through which the elongate member slidably and sealably extends, the pressurized conduit thus inhibiting escape of air from an interior of the capsized vessel while the plug is inserted into the aperture via the elongate member.

2. The plug insertion apparatus as claimed in claim 1 wherein the distal end of the elongate member is shaped to loosely threadably connect to the plug.

3. The plug insertion apparatus of claim 1 wherein, when the plug is inserted into an aperture with a friction fit that inhibits the plug from being dislodged therefrom, hand-rotation of the elongate planar member in a first rotational direction enables the elongate member to be removed from the plug.

4. The plug insertion apparatus as claimed in claim 1, further including a planar member coupled to a proximal end of the elongate member, the planar member extending laterally outwards from the elongate member and being shaped to receive pounding thereon.

5. The plug insertion apparatus of claim 1 further including a threaded cap which couples to an upper threaded female portion of the pressurized conduit, the threaded cap having a bore through which the elongate member slidably and sealably extends, and the plug insertion apparatus further including a planar member coupled to the elongate member adjacent to a proximal end of the elongate member, the planar member being larger than the aperture of the hull and larger than the bore of the threaded cap.

6. In combination, a plug and the plug insertion apparatus of claim 1, the plug comprising:

a deformable elongate body having a longitudinal axis, having a first end, having a second end spaced-apart from the first end, the ends being aligned along the axis, the body extending laterally outwards from the first end towards the second end thereof, and having an exterior surface; and indicia extending about the exterior surface of the elongate body.

7. A method of inserting a plug into an aperture of a hull of a vessel using the plug insertion apparatus of claim 1, the method comprising:

threadably connecting the plug to the distal end of the elongate member of the plug insertion apparatus by rotating the elongate member in a first rotational direction relative to the plug;

inserting the plug into the aperture of the hull;

applying a pounding force onto an enlarged proximal end portion of the elongate member to more fully insert the plug into the aperture of the hull; and removing the elongate member from the plug by rotating the elongate member in a second rotational direction opposite the first rotational direction.

8. The method of claim 7 further including, prior to the inserting of the plug step, providing indicia on said plug, and for the applying a pounding step, applying a pounding onto the enlarged proximal end portion of the plug insertion member until a pre-determined marking of said indicia aligns flush with the hull.

9. The method of claim 7 further including:

coupling a conduit to the hull such that a first end of the conduit sealably couples to the hull and the conduit extends about the aperture; and after the step of removing the elongate member from the plug, sealing a second end of the conduit via a threaded plug.

10. A kit comprising:

an object delivery apparatus shaped to fit through an aperture drilled into a hull of a capsized vessel;

the plug insertion apparatus of claim 1; and a pressurized conduit through which the object delivery apparatus and the plug insertion apparatus selectively slidably and sealably extend, the pressurized conduit inhibiting escape of air from the interior of the capsized vessel.

11. The kit as claimed in claim 10, further comprising a borescope insertion apparatus, the borescope insertion apparatus including a borescope and an elongate tube within which the borescope is received, the elongate tube being transparent at least in part and being shaped to selectively slidably and sealably extend through the pressurized conduit.

12. A hull penetration mount comprising:

a central conduit which selectively receives a drill and allows passage of pressurized air therethrough, the central conduit having an interior, an upper end, a lower end spaced-apart from the upper end, an exterior, and an opening positioned between the ends thereof, the opening extending from the interior to the exterior thereof; and a hatch extending across and sealing the opening in a closed position, the hatch being selectively removable from said opening, with the interior of the central conduit being accessible thereby.

13. The hull penetration mount as claimed in claim 12, further including a planar base coupled to and extending radially outwards from the conduit, and a plurality of braces coupled to and extending between the planar base and an exterior surface of the conduit.

14. The hull penetration mount as claimed in claim 12, wherein the conduit is transparent at least in part.

15. An object delivery apparatus for use by a rescuer to deliver an object to a person trapped within an interior of a capsized vessel, the object delivery apparatus comprising:

an elongate member having a distal end via which the object is coupled, the elongate member being shaped to extend through an aperture drilled into a hull of the capsized vessel such that the object is positionable within the interior of the capsized vessel;

a release mechanism via which the object is separated from the elongate member and delivered to the person; and wherein either i) the release mechanism includes a push rod having a retracted position, with the push rod being moveable from the retracted position to an extended position in which the push rod operatively abuts the object and causes the object to be released from the elongate member, or ii) the object delivery apparatus further includes a container within which the object is disposed, with the container threadably coupling to the distal end of the elongate member or magnetically coupling to the distal end of the elongate member.

16. The object delivery apparatus of claim 15 further including a pressurized conduit through which the elongate member slidably and sealably extends, the pressurized conduit inhibiting escape of air from the interior of the capsized vessel.

17. The object delivery apparatus of claim 16, the object delivery apparatus further including a threaded cap which couples to an upper threaded female portion of the pressurized conduit, the threaded cap having a bore through which the elongate member slidably and sealably extends, and the object delivery apparatus further including a stop collar coupled to the elongate member adjacent to a proximal end of the elongate member, the stop collar being larger than the aperture of the hull and larger than the bore of the threaded cap.

18. The object delivery apparatus of claim 15, further including one or more lights coupled to the elongate member adjacent the object.

19. A method of delivering an object to an interior of a capsized vessel using the object delivery apparatus of claim 15, the method comprising:

drilling an aperture through a hull of the capsized vessel;

coupling the object to the distal end of the elongate member of the object delivery apparatus;

inserting the elongate member through the aperture such that the object is positioned within the interior of the capsized vessel; and actuating the release mechanism of the object delivery apparatus, the object thus separating from the elongate member and being delivered into the interior of the capsized vessel.

20. The object delivery apparatus according to claim 15, wherein the object is one or more of a hand-graspable light, food, and an energy tablet.

* * * * *